United States Patent [19]

Awane et al.

[11] Patent Number: 4,598,379

[45] Date of Patent: Jul. 1, 1986

[54] CONTROL SYSTEM OF AN AUTOMATIC VENDING MACHINE

[75] Inventors: Misao Awane; Seiji Hara; Satoshi Kobayashi, all of Saitama, Japan

[73] Assignees: Sanyo Electric Co., Ltd.; Tokyo Sanyo Electric Co., Ltd., both of Japan

[21] Appl. No.: 550,916

[22] Filed: Nov. 10, 1983

[30] Foreign Application Priority Data

| | | | |
|---|---|---|---|
| Nov. 12, 1982 | [JP] | Japan | 57-199268 |
| Nov. 12, 1982 | [JP] | Japan | 57-199269 |
| Nov. 19, 1982 | [JP] | Japan | 57-203942 |
| Nov. 19, 1982 | [JP] | Japan | 57-203943 |
| Nov. 19, 1982 | [JP] | Japan | 57-203944 |
| Nov. 27, 1982 | [JP] | Japan | 57-208280 |

[51] Int. Cl.[4] ..... G07F 11/00

[52] U.S. Cl. ..... 364/479; 364/132

[58] Field of Search ..... 364/132, 478, 479; 194/1 N, DIG. 3

[56] References Cited

U.S. PATENT DOCUMENTS

| | | | |
|---|---|---|---|
| 4,247,899 | 1/1981 | Schiller et al. | 364/479 X |
| 4,267,915 | 5/1981 | McLaughlin et al. | 194/DIG. 3 |
| 4,432,064 | 2/1984 | Barker et al. | 364/132 X |
| 4,512,453 | 4/1985 | Schuller et al. | 194/1 N |

OTHER PUBLICATIONS

Two Coordination Principles & Their Application in Large Scale Systems Control, *Automatica,* by Mesarovic, Macko, and Takahara, vol. 6, pp. 261–270, Pergamon Press, Great Britain, 1970.

*Primary Examiner*—Joseph Ruggiero
*Assistant Examiner*—Allen MacDonald
*Attorney, Agent, or Firm*—Darby & Darby

[57] ABSTRACT

At least two microcomputers are provided for the controlling operation of an automatic vending machine, which are connected by signal wires of a number selected from one to four with respect to each other. One of the microcomputers is a main microcomputer, while the other thereof is a submicrocomputer. The submicrocomputer performs the controlling operation on the restricted block functions of the automatic vending machine, while the main microcomputer transmits control codes to the submicrocomputer through the signal wire to control the operation thereof, and controls the automatic vending operation while serially transmitting or receiving the necessary data.

9 Claims, 26 Drawing Figures

CONTROL SYSTEM OF AN AUTOMATIC VENDING MACHINE

BACKGROUND OF THE INVENTION

The present invention relates to a control system of an automatic vending machine and more particularly, to a control circuit to be controlled by microcomputers for the controlling operation of an automatic vending machine.

In recent years, the application of the microcomputers to the automatic vending machines is actively performed not only to greatly contribute towards the function improvements, but also to deal with various problems. In the automatic vending machine, the control circuit has to perform the actions such as inserted money-amount operation, balance operation after the sales, no-changes detection, commodity sell-out detection, sold-out commodity display, purchasable commodity decision, purchasable commodity display, commodity-selection-switch-action detection, commodity delivery, change payment, etc. However, the control circuit under the control of the conventional microcomputers is often connected, one to one, with the terminal apparatuses such as switch apparatus, driving apparatus, display apparatus. When one microcomputer of the control circuit directly controls each of the terminal apparatuses concentrically, the following defects are caused due to the concentration of the functions upon the control circuit.

(1) Assembling operation efficiency;

The operation efficiency in the assembling process is inferior due to the increased number of the base-plate components of the control circuit unit. The increased defect factor implies the analysis of the defect caused and the repair to be difficult to be performed. Also, as signal wires from the control circuit increase in number, the problems of wiring disposal and error wiring increase.

(2) Design efficiency;

The base plates of the control circuit unit are required to be individually designed with respect to each of the automatic vending machines. Also, the hardwares and the softwares thereof are becoming complicated due to multiple functions. Particularly, the softwares have problems in their work assignments, thus resulting in heavy loads on the software engineers, and requirement of more time for development and debugging.

(3) Service;

The control circuit becomes so large that the repairing operation is difficult to be effected, with the result that the service cost becomes higher.

In the U.S. Pat. No. 4,267,915, data bus bars and a multiplex system are adopted in the circuit construction, which introduces the price data of the sales commodity to the control circuit. The idea of such bus bars and multiplex is applied even to the other signal system of the automatic vending machine so that increase in the number of the wirings can be coped with to some extent. However, in the U.S. Pat. No. 4,267,915, the data bus bars and the multiplex do not result in the effective number reduction of the wirings, because the data are transmitted in parallel. In the many uses of the multiplex system in the signal system, the transmission and reception of signals are hardly performed one to one between the control circuit and each of the terminal apparatuses. When something unusual has happened, it becomes difficult to analyze which terminal apparatus is wrong or whether or not the control circuit is wrong. Thus, inconveniences on the service increase. Also, in the effective reduction of the number of the wirings, the serial transmission of the data between the control circuit and each terminal is disclosed in the Japanese Patent Publication (Tokkosho) No. 58-16230. However, in the Japanese Patent Publication (Tokkosho) No. 58-16230, the number of the wirings can be effectively reduced, but the function concentration on the control circuit remains unsolved. The defects are difficult to be analyzed, and problems remain in terms of assembling operation, design efficiency, service.

SUMMARY OF THE INVENTION

An object of the present invention is to provide a control system of an automatic vending machine, whose number of wirings is considerably reduced.

Another object of the present invention is to provide a control system of an automatic vending machine, whose failure can be easily analyzed when something unusual has happened.

A further object of the present invention is to provide a control system of an automatic vending machine, wherein the control is dispersed for each of the function blocks.

A still further object of the present invention is to provide a control system of an automatic vending machine, wherein a test action can be singly performed for each of the function blocks.

Another further object of the present invention is to provide a control system of an automatic vending machine, wherein the assembling operation is improved.

A still further object of the present invention is to provide a control system of an automatic vending machine, wherein the optional components of various functions can be easily mounted.

According to the present invention, there provides a control system of an automatic vending machine comprising a submicrocomputer for the controlling operation on the restricted function blocks of an automatic vending machine, a main microcomputer for collectively controlling said submicrocomputer, signal wires of a number selected from one to four provided so that said main microcomputer and said submicrocomputer may transmit and receive the data serially with respect to each other, wherein said main microcomputer transmits instruction code data serially to said submicrocomputer through said signal wires to control the operation of said submicrocomputer, said submicrocomputer receives said data to be transmitted serially through said signal wires when the instruction code data for ordering the reception of the data from said main microcomputer is transmitted, said submicrocomputer controls said function block in accordance with said data, said submicrocomputer transmits said detection data serially to said main microcomputer through said signal wires when the instruction code data for ordering the transmission of the detection data within said function blocks is transmitted, said main microcomputer controls the entire operation of the automatic vending machine in accordance with said detection data.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
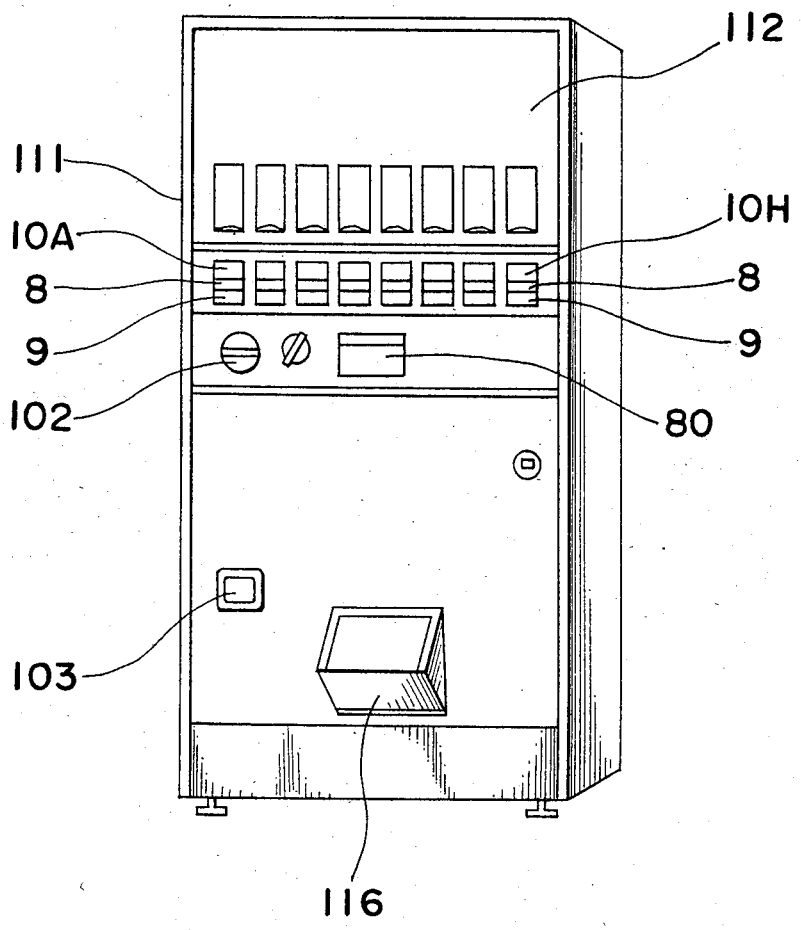
FIG. 1 is a perspective view showing the front face of an automatic vending machine.

Before the description of the present invention proceeds, it is to be noted that like parts are designated by like reference numerals throughout the accompanying drawings.

Figure 2:
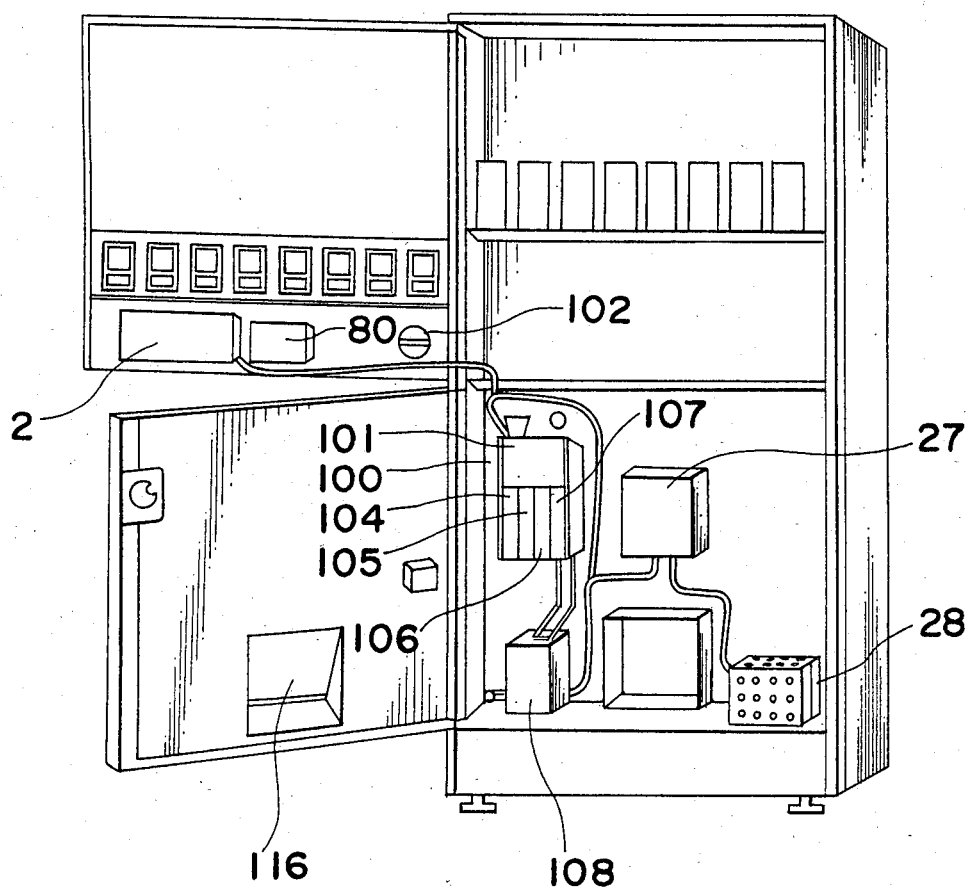
FIG. 2 is a view showing a condition where the front-face door of the automatic vending machine is opened.
Figure 3:
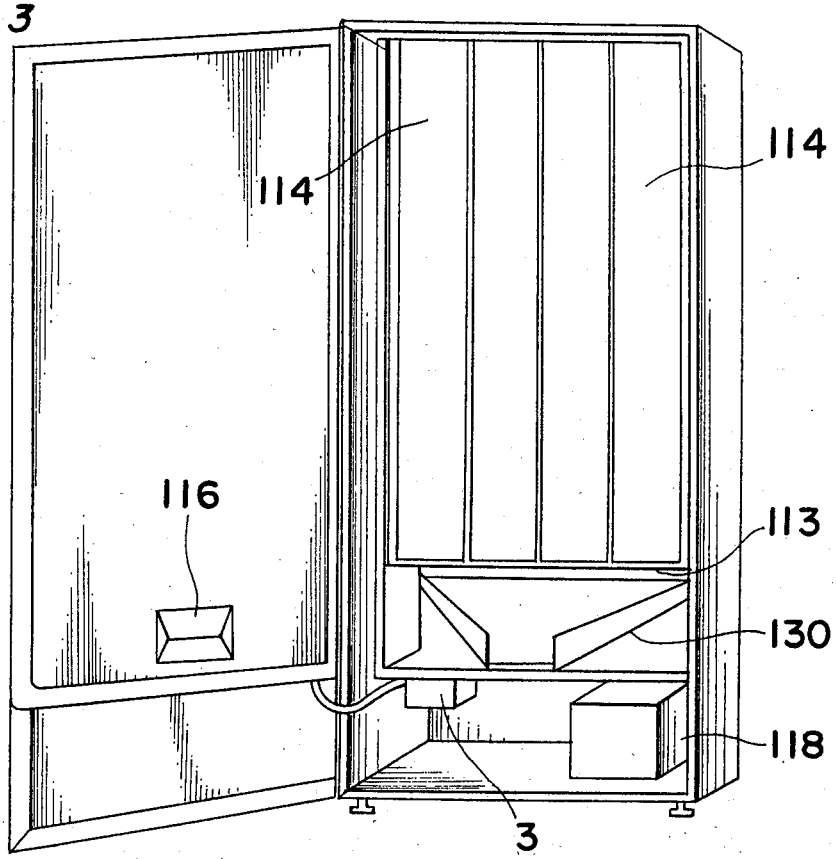
FIG. 3 is a view showing a condition where the box inside door of the automatic machine is opened.

The components, constituting an automatic vending machine, shown from FIG. 1 to FIG. 3 are classified into the following function blocks.

(1) Coin Mechanism 100 a. Coin Detecting Unit 101

Coins, which come from a coin slot 102 of an automatic vending machine, are detected by this unit. Bogus coins are caused to return to a return opening 103. The coin detecting unit outputs, with respect to the genuine coins, the respective insert coin signal for each money kind of 10 yen, 50 yen, 100 yen, 500 yen, and guides them to change pipes 104, 105, 106, 107 for money-kind use or a cash box 108.

b. Change Payment Unit 103

Figure 4:
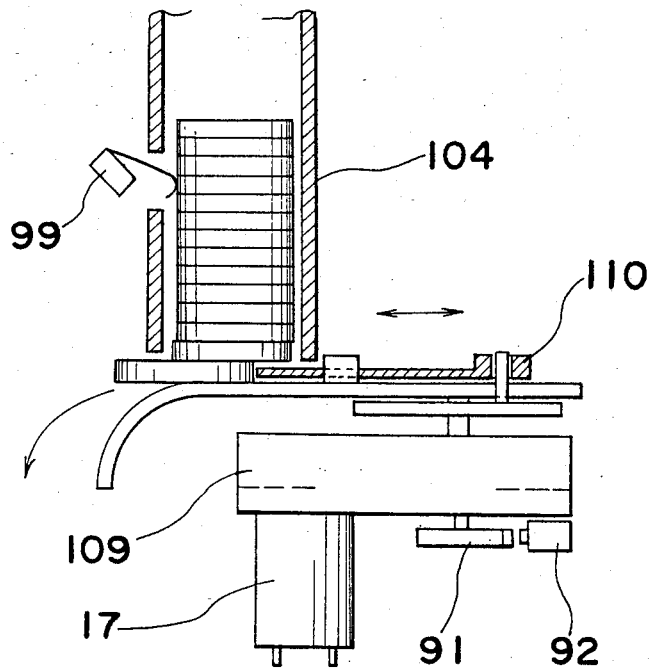
FIG. 4 is a side sectional view of the change payment apparatus.

As shown in FIG. 4, the change return unit is provided with change payment motors 17, 18, 19, 20, which correspond to the change pipes 104, 105, 106, 107. During the change discharging operation, the return unit drives one of the change payment motors 17, 18, 19, 20 corresponding to the payment coin kind to reciprocatingly move a coin pushing plate 110. The coins are picked up from the change pipes with payment coin kinds accommodated therein and are discharged into the change return opening 103. The coin pushing plate 110 and a reduction gear 109 are provided for each of the change payment motors 17, 18, 19, 20. The existence of the changes provided within the pipes 104, 105, 106, 107 is detected by a switch 99.

(2) Front Panel Unit 111

This unit is composed of a signboard 112 for displaying the sales commodities, an inserted money-amount display 7 for displaying the money amounts of the inserted coins, a purchasable commodity display 8 for each of the commodities which are displayed in accordance with conditions of inserted money-amount, selling prices, changes available, a sold-out commodity display 9 for each of the commodities, which shows non-selling commodities due to sold-out condition or the other reasons, selection switches 10A through 10H for instructing a commodity to be purchased, and so on.

(3) Vending Apparatus 113

Figure 6:
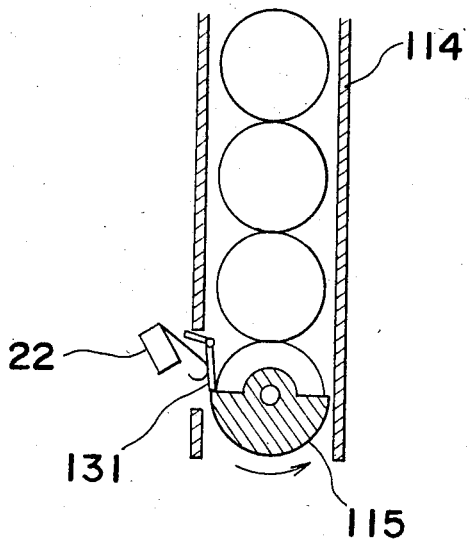
FIG. 6 is a view for explaining the operation of the commodity vending mechanism.
Figure 7:
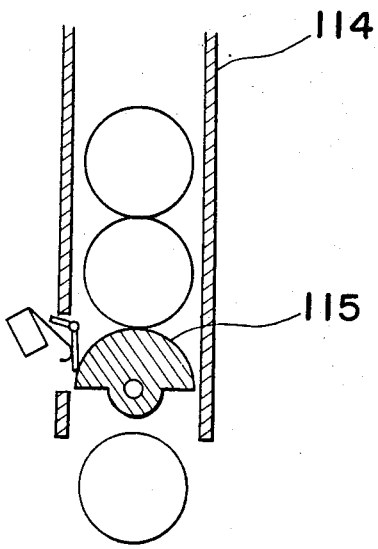
FIG. 7 is a view for explaining the operation of the commodity vending mechanism.

The vending apparatus, which is provided with commodity accommodating racks 114 in accordance with sales commodity kinds, commodity discharging motors 21 to be speed-reduced by the reduction gear 117 and the commodity discharging drum 115, drives one of commodity discharging motor 21 corresponding to the racks 114 with the selected commodity kind accommodated therein to rotate a commodity discharging drum 115 as shown in FIGS. 6 and 7 for delivering the commodity through the shoot 130 into a delivery opening 116. Also, an oscillating plate 131 which oscillates in accordance with the existence or the absence of the commodity, and a sold-out switch 22 to be turned on and off by the oscillation of the oscillating plate 131 are provided on each of the accommodating racks 114.

(4) Controlling Unit 27

The controlling unit concentrically controls each function blocks. In recent years, the controlling unit is changing from a relay controlling system to a microcomputer controlling system. Data, which are necessary for the automatic vending operation, such as selling prices, etc. are preset.

(5) Power Unit 28

The power unit generates DC stabilizing voltage into the controlling unit and the respective other function blocks. No power units are required in the automatic vending machine of a relay controlling system.

(6) Cooling/Heating Unit 118

The cooling/heating unit is an apparatus for cooling or heating the sales commodity, a compressor and a heater being employed. A temperature controlling device is provided with to maintain the commodities in a proper temperature. Conventionally, this unit was often controlled independently, but recently some machines have this unit combined with the control unit with an aim to power-saving.

(7) Optional Components

Various apparatuses are adapted to be mounted as optional components to meet the customers' requirements. The main optional components are a bill identifying apparatus (bill validator), a change auxiliary apparatus, a voice composing apparatus, a power-saving timer, a sold-amount totalling apparatus, etc.

Figure 8:
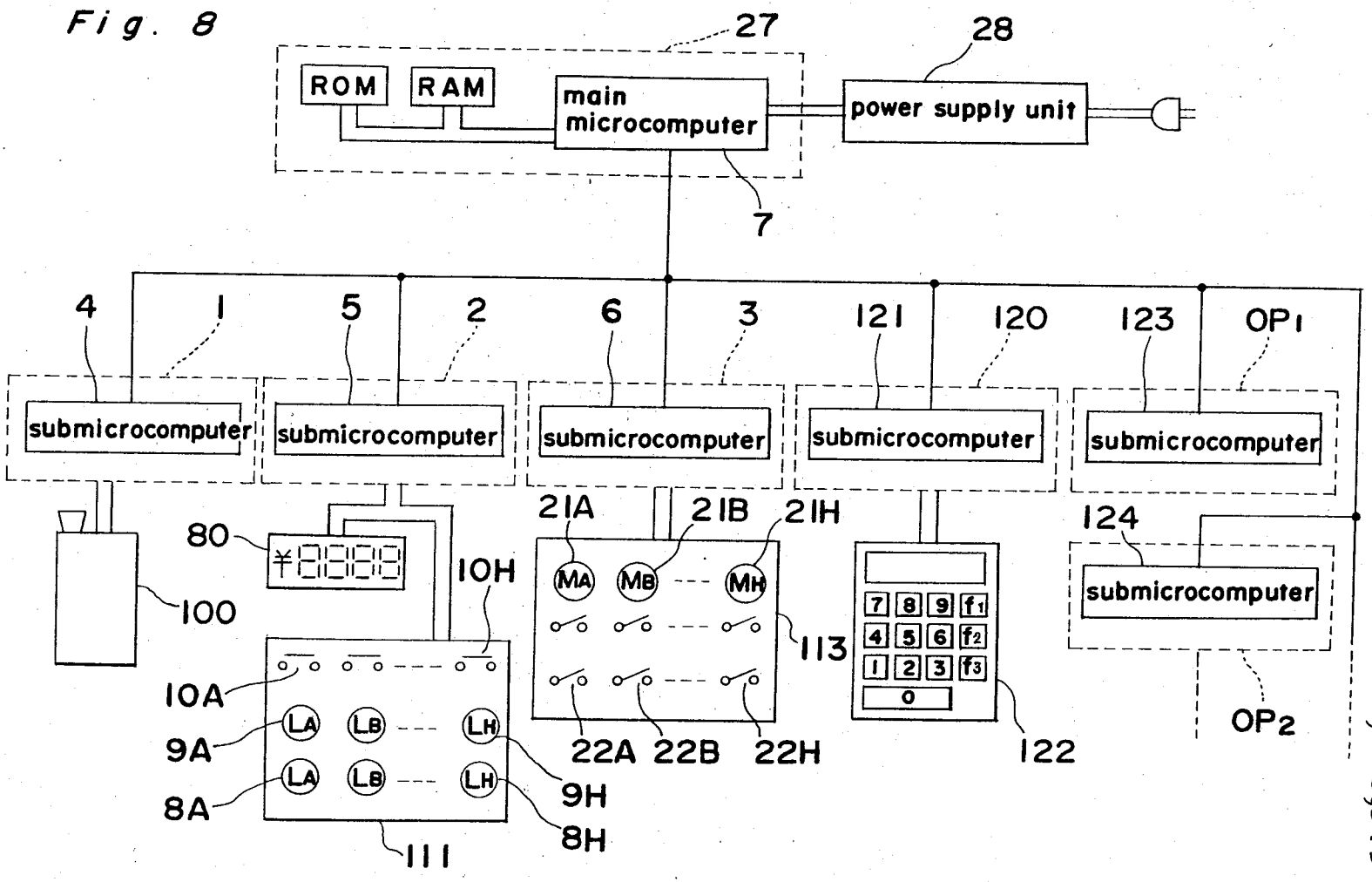
FIG. 8 is a system diagram for explaining an automatic vending machine in accordance with the present invention.
Figure 22:
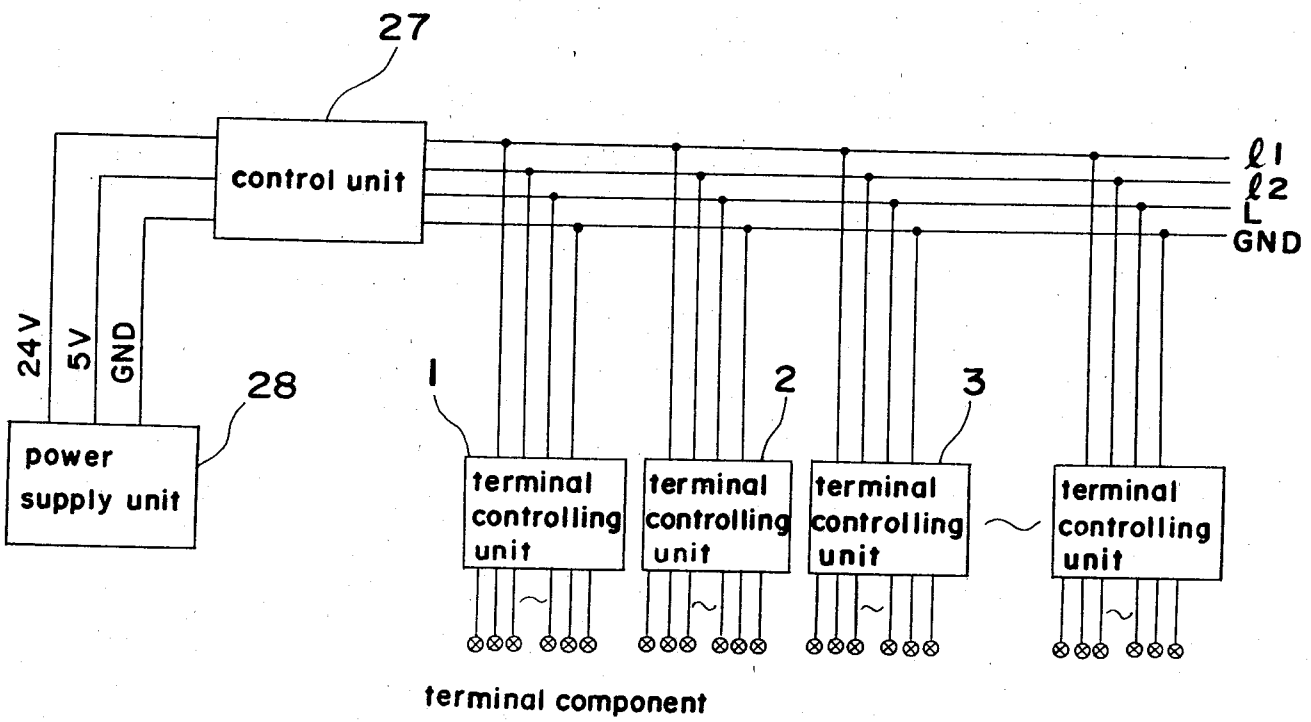
FIG. 22 is a wiring system diagram of an automatic vending machine in accordance with the present invention.

FIG. 8 shows a controlling system of the automatic vending machine of the present invention. The controlling unit 27 has a main microcomputer 7 disposed. The coin mechanism 100, the front panel unit 111, the vending apparatus 113 have their respective low-priced submicrocomputers for controlling the operation and disposed to form the controlling units 1, 2, 3 in the respective function blocks. The main microcomputer 7 is connected with each of the submicrocomputers 4, 5, 6 with one common signal wire so that control instructions or data are transmitted to or received from each other through the signal wire. In this controlling system, the number of the final wirings to the terminal apparatus remains unchanged. The number of the wirings from the controlling unit 27 to the controlling unit for each of the function blocks is one (four including the power line) so that the number of the wirings is extremely reduced. FIG. 22 shows the wiring system of the automatic vending machine in accordance with the present invention, wherein the controlling unit 27 is connected with the controlling units 1, 2, 3 by a power service line $P_1$ of 24 volts, a power line $P_2$ of 5 volts, an earth line GND, a signal wire L. The power source of the 24 volts is a driving power-source of the commodity discharging motor, etc. The power source of the 5 volts is an operation power-source of the submicrocomputers 4, 5, 6. Also, the signal wire L is one in the example of FIG. 8 and FIG. 22. Four wirings connecting between each of the controlling units 1, 2, 3 with the controlling unit 27 will do even if three power lines are provided. As the signal wire transmits and receives the data by the variation in the voltage, the earth line GND is indispensable to be commonly connected with. In the description of the present specification, the earth line GND is described separately from the signal wire. Also, in the present invention, the data are characterized by the serial transmission and reception of the data with respect to each other between the main microcomputer 7 and the submicrocomputers 4, 5, 6. In the serial transfer of the data, the signal wire shown in FIG. 8 can be two, three or four in addition one in number of which each case will be described later. The components concentrated in the controlling unit 27 can be dispersed into the controlling unit for each of the function blocks. Likewise, the softwares can be dispersed, too. Thus, the self-diagnosing function for each of the blocks can be improved so that the failures during the abnormal condition can be easily analyzed. Speaking of the reduction in the number of the wirings, there are various methods, in accordance with the types of the various automatic vending machines, in the dispersion in the function blocks. For example, in an automatic vending machine, wherein the control unit 27 is close to the front panel unit 111, the effect is inferior due to the short distance even if the controlling unit 27 is connected with the front panel unit 111 with one signal wire. In such a case, the control of the front panel unit 111 should be performed by the main microcomputer 7. The submicrocomputers 4, 6 should be disposed respectively in the coin mechanism 100 and the vending apparatus 113 and should be connected with the main microcomputer 7 with the common signal wire. Accordingly, in the function blocks disposed away from the controlling unit 27, the submicrocomputer is disposed to disperse the functions, and is connected with the main microcomputer 7 with a signal wire so that the number of the wirings can be effectively reduced. Normally, within the automatic vending machine, the controlling unit 27 is farthest from the vending apparatus 113. If the controlling operation of the coin mechanism 100, the front panel unit 111 is concentrated on the main microcomputer 7, and the submicrocomputer 6 is disposed only on the vending apparatus 13 to disperse the sales controlling functions, the effect is superior in the reduction of the wirings. However, if the controls of some function blocks are concentrated on the main microcomputer 7, the failure analyzing effect becomes inferior. Also, a data loading unit 120, which is composed of key boards, loads data, necessary for selling actions, such as commodity selling prices, etc. for the respective sales commodity kinds to the controlling unit 27. The data loading unit is controlled by the submicrocomputer 121 to be connected with the main microcomputer 7 with the common signal wire. The optional apparatuses $OP_1$ through $OP_n$ such as the bill identifying apparatus, the voice composing apparatus, the sold-amount totalling apparatus, etc. to be mounted if necessary are controlled by the submicrocomputers 123, 124 to be respectively connected with the main microcomputer 7 by the common signal wire. The optional apparatus is connected with the signal wire and some software portions are added to the main microcomputer 7. Functions can be added without any change in the constructions of the other controlling units 1, 2, 3, thus resulting in superior functional expansion.

A case where the submicrocomputers 4, 5, 6 are disposed, with respect to the control unit 27, respectively, in the function blocks of the coin mechanism 100, the front panel unit 111, the vending apparatus 113 or the like will be described hereinafter.

Figure 9:
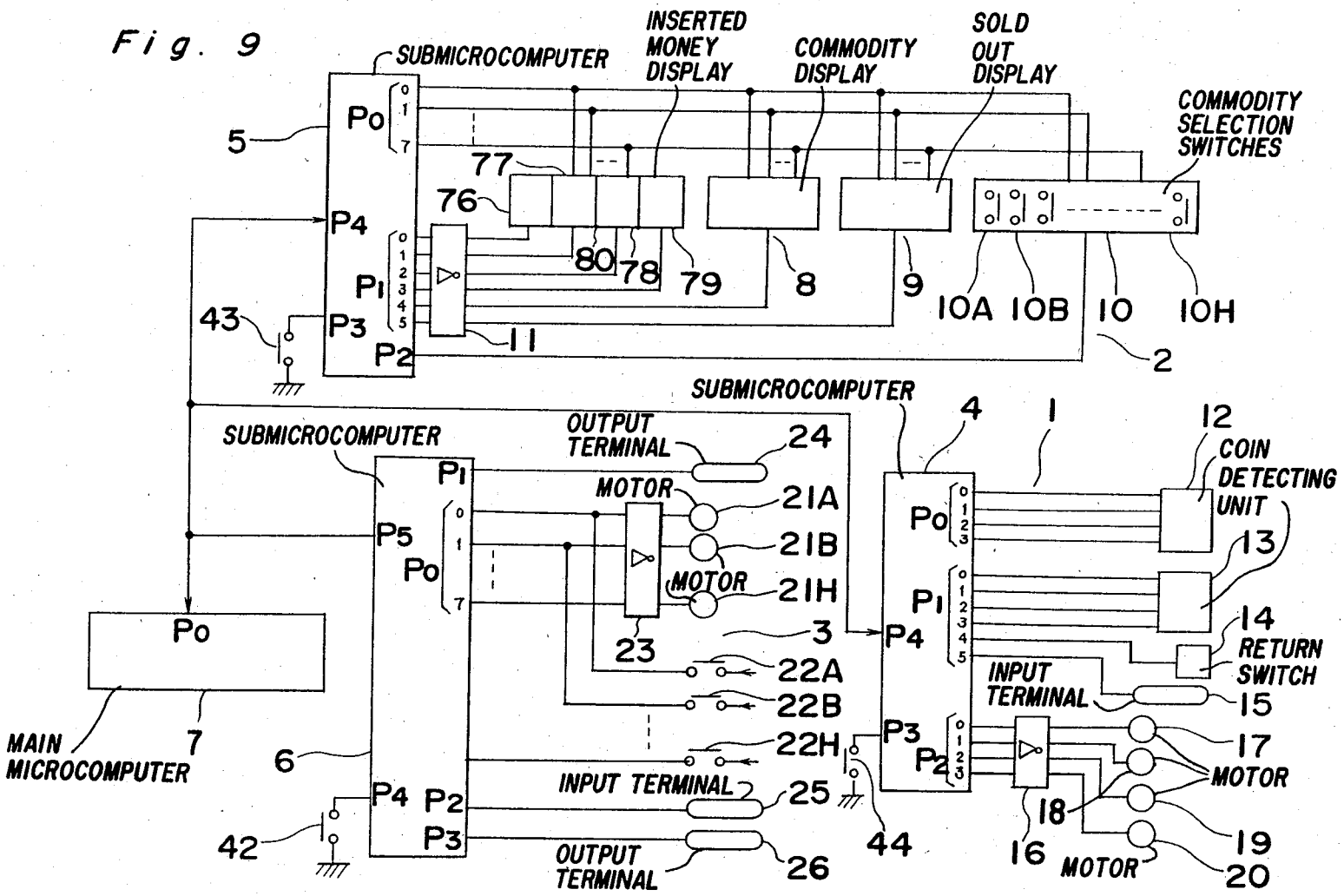
FIG. 9 is a control circuit diagram of an automatic vending machine in accordance with the present invention.

FIG. 9 shows the controlling circuit of the automatic vending machine in accordance with the present invention. There provide a main microcomputer 7 in the controlling unit 27, a coin mechanism controlling unit 1, a front panel controlling unit 2, and a sales controlling unit 3. The main microcomputer 7 performs its central controlling operation of the vending machine along the predetermined program. The front panel controlling unit 2 is provided with a submicrocomputer 5. An inserted money-amount display 80 composed of four digital displays 76, 77, 78, 79, a purchasable commodity display 8 provided with LEDs corresponding to eight kinds of commodities ranging from A to H, a sold-out commodity display 9, a commodity selection switch circuit 10 provided with the commodity selection switches 10A through 10H are connected with the output port $P_0$ of the submicrocomputer 5. In addition, the respective terminals 0 through 5 of the output port $P_1$ of the submicrocomputer 5 are connected with the respective displays through a driver 11. The input port $P_2$ is connected with the commodity selection circuit 10. Also, the coin mechanism controlling unit 1 which is provided with a submicrocomputer 4 has a coin detecting unit 12, which outputs an inserted coin signal in accordance with the coin kinds of 10 yen, 50 yen, 100 yen, 500 yen, connected with the input port $P_0$; has a coin detecting unit 13, which detects the existence of the changes for each coin kind accommodated for change use to output a no-change signal, a return switch 14, which is operated by customers during the returning operation of the inserted money-amount or the remained amount, a common input terminal 15 from each microswitch, which turns on and off through the operative cooperation with the change discharging motor, connected with the input ports $P_1$; and has the change payment motors 17, 18, 19, 20, for the respective change coin kinds through the driver 16, connected with the output port $P_2$. Also, the sales controlling unit 3, which is provided with a microcomputer 6, has sold-out switches 22A through 22H in accordance with the respective commodities ranging from A to H, commodity discharging motors 21A through 21H, which correspond to the respective commodities through the driver 23, connected with the port $P_0$; has a common output terminal 24, into each of the commodity discharging motor, connected with the port $P_1$; has a common input terminal 25 of each microswitch, which turns on and off through the operative cooperation with the commodity discharging motor, connected with the port $P_2$; and has a common output terminal 26, into each sold-out commodity switch, connected with the port $P_3$.

Figure 10:
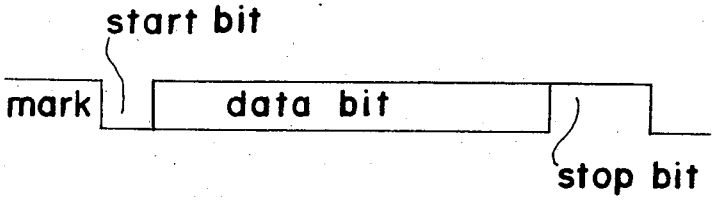
FIG. 10 is a chart showing the format of transfer data.

The respective submicrocomputers 4, 5, 6 are connected, with one signal wire, in parallel to the main microcomputer 7, and are adapted to transfer, in the non-synchronous system, data serially with respect to each other through the main guidance of the main microcomputer 7. The data are of five types, a terminal specifying data, with which the main microcomputer 7 specifies either of the submicrocomputers 4, 5, 6, an instruction code data, with which the main microcomputer 7 instructs actions to each of the submicrocomputers 4, 5, 6, a check-sum data, a confirming data by the check-sum, and a sales data. In addition, the sales data, which the main microcomputer 7 and each of the submicrocomputers 4, 5, 6 transfer with respect to each other are of an inserted coin data, no-change existing data, a selected commodity data, a sales commodity data, a money-amount display data, a purchasable commodity data, a sold-out commodity data, a discharging data, a coin discharging data, and a sales completion data. In the present embodiment, the data are transferred 8 bits by 8 bits. As shown in the format of FIG. 10, the start bit "L" of 1 bit, and the stop bit "H" of 2 bits are added, respectively, to the front and the back of the data bit of 8 bits so that the data of 11 bits are transferred. Accordingly, the terminal specifying data and the instructing code data, respectively, of 4 bits are disposed on the upper column 4 bits and the lower column 4 bits of the data bit and are transferred as the control data.

Figure 11:
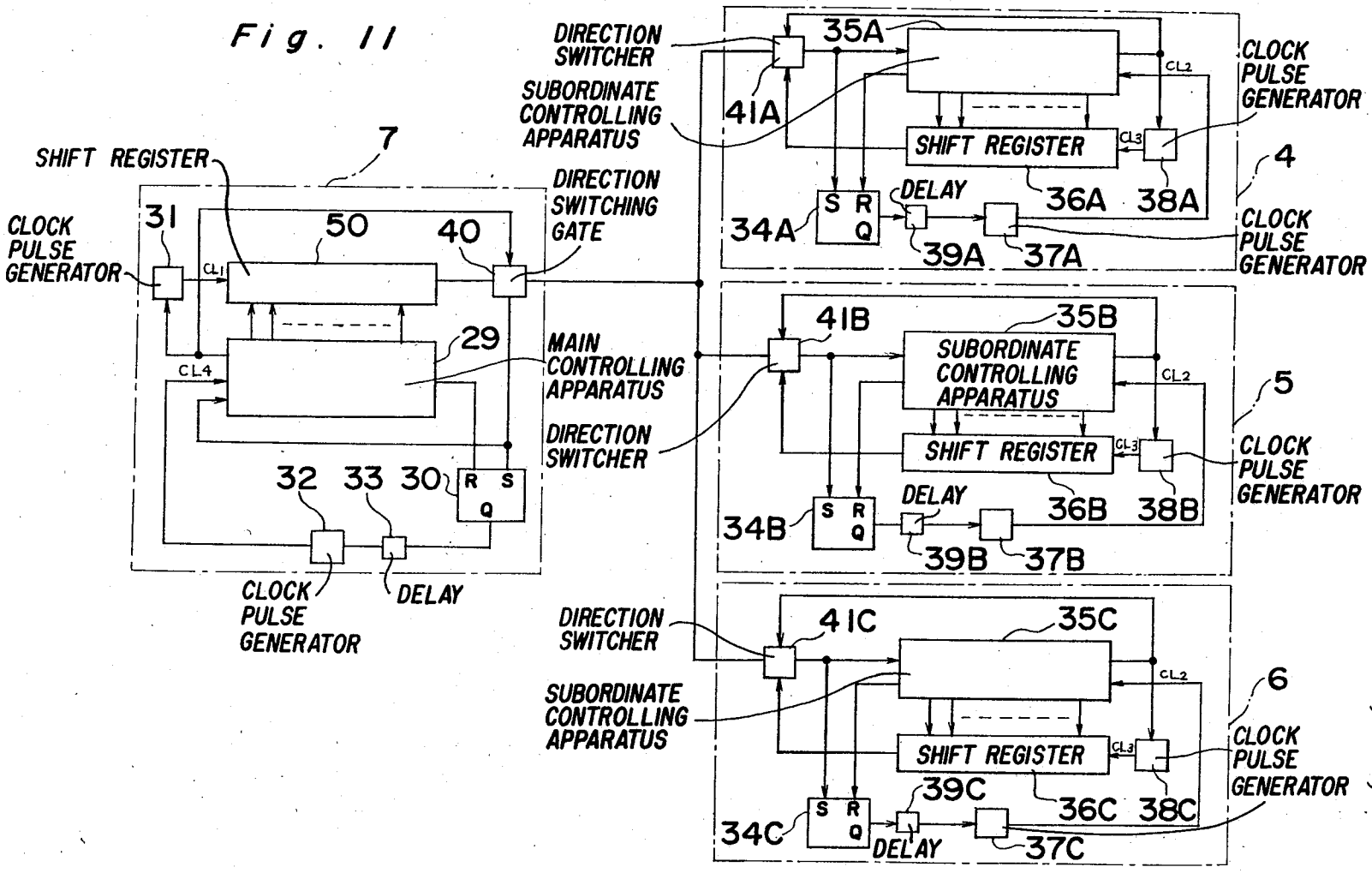
FIG. 11 is a functional block diagram for explaining the data transfer between a main microcomputer and each of submicrocomputers.

FIG. 11 is a function block diagram for explaining the actions of the main microcomputer 7 and the submicrocomputers 4, 5, 6 during the data transferring operation. The main microcomputer 7 is provided with functions of a main controlling apparatus 29 for deciding the data transfer to the submicrocomputers 4, 5, 6, a shift register 50 of 11 bits for serially converting the transfer data, a flip-flop circuit 30 to be set by the start bit of the transfer data from the submicrocomputers 4, 5, 6, a both-direction switching gate 40 of the transmission and receiver, clock pulse generating circuits 31, 32, and a delaying circuit 33. Also, the submicrocomputers 4, 5, 6 are provided with functions of a flip-flop circuits 34A, 34B, 34C for setting through detection of the start bit of the data to be transferred from the main microcomputer 7, subordinate controlling apparatuses 35A, 35B, 35C for controlling the data transfer with respect to the main microcomputer 7, shift registers 36A, 36B, 36C of 11 bits for the serial conversion of the transmission data to the main microcomputer 7 stored in the subordinate controlling apparatuses 35A, 35B, 35C, clock pulse generating circuits 37A, 37B, 37C, 38A, 38B, 38C, both-direction switching gates 41A, 41B, 41C for the transmission and the receiver, delaying circuits 39A, 39B, 39C. The clock pulse generating circuits 31, 32, 37A, 37B, 37C, 38A, 38B, 38C always generate respectively eleven clock pulses CL1, CL2, CL3, CL4 of the same period. The clock pulse CL2 to be outputted from the clock pulse generating circuits 37A, 37B, 37C, and the clock pulse CL4 to be outputted from the clock pulse generating circuit 32 respectively lags the clock pulse CL3 to be outputted from the clock pulse generating circuits 38A, 38B, 38C, and the clock pulse CL1 to be outputted from the clock pulse generating circuit 31 by a phase difference of 180° by the functions of the delaying circuits 39A, 39B, 39C, 33 as shown in the timing chart of FIG. 12.

The data transfer between the main microcomputer 7 and each of the submicrocomputers 4, 5, 6 starts through the transmission of the control data of one byte composed of the terminal specifying data and the instruction code data by the main microcomputer 7. As shown in the format of FIG. 10, the transmission terminal of the main microcomputer 7 is normally in the mark condition "H". Also, the both-direction switching gates 41A, 41B, 41C of the submicrocomputers 4, 5, 6 are ready to receive the data. After the main controlling apparatus 29 has set the transfer data of 11 bits in the shift register 50, the apparatus causes the both-direction switching gate 40 to be ready for transmission and the clock pulse generating circuit 31 to act thereby to introduce the clock pulse CL1 to the shift register 30. The start bit "L" is transmitted to set the flip-flop circuits 34A, 34B, 34C of the respective submicrocomputers 4, 5, 6. After the flip-flop circuits 34A, 34B, 34C have been set, the clock pulse generating circuits 37A, 37B, 37C operate delayed by the delaying circuits 39A, 39B, 39C to output the clock pulse CL2, which lagged the clock pulse CL1 by a phase difference 180°. However, the subordinate controlling apparatuses 35A, 35B, 35C sample the transfer data from the main microcomputer 7 in synchronous relation with the rising of the clock pulse CL2 to sample the data of 11 bits respectively at a ½ bit timing as shown in FIG. 3. However, the subordinate controlling apparatuses 35A, 35B, 35C of the respective submicrocomputers 4, 5, 6 respectively output reset signals to the flip-flop circuits 34A, 34B, 34C, after the sampling operation of the transfer data of 11 bits has been completed, to complete the transfer of the terminal specifying data and the instruction code data.

The subordinate controlling apparatuses 35A, 35B, 35C of the respective submicrocomputers 4, 5, 6 make out terminal specifying data and instruction code data transmitted. Only the submicrocomputer specified by the main microcomputer 7 operates along the instruction code data. Assume that the submicrocomputer 4 has been specified, and if the instruction code orders the reception of the sales data, the submicrocomputer 4 sets the flip-flop circuit 34A by the start bit of the transfer data to be transmitted continuously from the main microcomputer 7 to sample the transfer data in synchronous relation with the clock pulse CL2. And the main microcomputer 7 sets the check-sum data of one byte into the shift register 50 after the transmission of the transfer data to transmit the data. The submicrocomputer 4 sets the flip-flop circuit 34A by the start bit of the transfer data of the check-sum to sample the transfer data of the check-sum. However, the subordinate controlling apparatus 35A decides the proper received data by the check-sum data to transmit the confirmation data to the main microcomputer 7 when it is proper. Also, when the instruction code is adapted to order the transmission of the sales data, the subordinate controlling apparatus 35A sets the transfer data of the sales data in the shift register 36A and thereafter to operate the clock pulse generating circuit 38A. Accordingly, the clock pulse CL3 is introduced into the shift register 36A and the transfer data are sequentially transmitted through the both-direction switching gate 40 in its reception readiness. The flip-flop circuit 30 is set by the "L" of the start bit. As the clock pulse generating circuit 32 operates later in the delaying circuit 33 than the setting of the flip-flop circuit 30, the clock pulse CL4, lagged the clock pulse CL3 by a phase difference of 180°, is outputted. However, the main controlling apparatus 29 samples data to be transferred in synchronous relation with the rising of the clock pulse CL4. After the sampling of the data of 11 bits, the reset signal is outputted to the flip-flop circuit 30 to finish the transfer of the sales data. Thereafter, the subordinate controlling apparatus 35A sets the transfer data of the check-sum into the shift register 36A to transmit it. The main microcomputer 7 sets the flip-flop circuit 30 by the start bit of the transfer data of the check-sum to sample the transfer data. And the main controlling apparatus 29 decides whether the reception data is proper by the check-sum data. When it is proper, the confirmation data is transmitted onto the main side 27. It is to be noted that the description of the checksum-data transfer will be omitted hereinafter.

The submicrocomputer 4 of the coin mechanism controlling unit 1 in its waiting condition repeatedly detects the generation of the output signals from the coin detecting unit 12, the change detecting unit 13, the returning switch 14 while sequentially scanning the signal condition of each signal wire of the ports $P_0$ and $P_1$ to store the inserted coin data, the no-change existing data in the inner memory. In the present example, the inserted coin data is composed of four bytes (8 bits one byte). Each number of the inserted coins 10 yen, 50 yen, 100 yen, 500 yen is shown in 8 bits. Also, the no-change existing data is composed of one byte. Each of the no-change existing data of 10 yen, 50 yen, 100 yen, 500 yen is shown in 4 bits. The operation information of the return switch 14 is shown in 1 bit. And the submicrocomputer 4 transmits these detection data to the main microcomputer 7 once the terminal specifying data and the instruction data for ordering the transmission of the sales data are inputted thereinto from the main microcomputer 7, these detection data are transmitted to the main microcomputer 7. When the confirmation data by the check-sum is transmitted from the main microcomputer 7, the memory of the data is cleared. Also, when the terminal specifying data and the instruction code data for ordering the change paying operation are transferred from the main microcomputer 7, the submicrocomputer 4 performs its change paying operation in accordance with the discharging data to be transferred continuously from the main microcomputer 7. In the present example, as the coin kinds to be paid as the changes are determined by the main microcomputer 7, the paying data is composed of four bytes. Each number of payment coins of 10 yen, 50 yen, 100 yen, 500 yen is shown, respectively, in 8 bits. Accordingly, the submicrocomputer 4 outputs the "H" signal from the terminals 0 through 3 corresponding to the payment coin kinds of the port $P_2$ by the payment data transferred to drive either of the motors 17, 18, 19, 20 to do the change paying operation. When the payment coin kinds are plural, the coin of a large sum has priority. As shown in FIG. 4, the submicrocomputer 4 detects, by the input terminal 5 of the port $P_1$, the input signal from the microswitch 92 to be turned on and off through the operative cooperation with the driving operation of the change payment motor by the rotation of the cam 91. In the present example, the microswitch 92 generates the "H" in its waiting condition. The "L" is provided due to the driving start of the change paying motor. When the change payment motor pivots enough to pay one coin, the "H" is adapted to be outputted again. On the other hand, after the transmission of the payment data, the main microcomputer 7 transmits the instruction code data for ordering the transmission of the coin payment data. The coin payment data shows the completion of one coin payment. In the present example, when the instruction code data is transferred, the submicrocomputer 4 is adapted to transmit the output data of the microswitch 92 at that time. Accordingly, the main microcomputer 7 confirms that the change is being paid, when the received data shows the "L" of the microswitch output, and transmits the instruction code data again. However, when the microswitch output becomes the "H" from the "L", the submicrocomputer 4 stops the output of the "H" signal from the port $P_2$ as completion of one coin payment. In this condition, the main microcomputer 7 outputs the instruction code data. Thus, when the data showing the "H" of the microswitch output is transmitted from the submicrocomputer 4, the data is considered as the coin paying data to detect the payment of one coin. Also, the submicrocomputer 4 detects the inputting operation of the inputted coin signal to the port $P_1$ while controlling such change payment.

Also, the submicrocomputer 5 of the front panel controlling unit 2 stores, in its inner memory, the money-amount display data of four bytes showing the 7-bit segment data of each digit on the four-digit inserted money-amount display transferred from the main microcomputer 7, purchasable commodity data of one byte showing, with each bit, whether eight kinds of commodities ranging from A to H can be purchased or not, and sold-out commodity data, of one byte, showing, with each bit, whether eight kinds of commodities are respectively sold out. The submicrocomputer 5 sequentially outputs these data one byte by one byte in parallel from the port $P_0$, and the "H" is sequentially outputted from the port $P_1$ to a display corresponding to the output data to perform pulse lighting operation. The submicrocomputer 5 sequentially output the "H" to each of the terminals 0 through 7 of the port $P_0$, before and after it outputs the "H" from each of the terminals 0 through 5 of the port $P_1$, to reply it to decide whether or not the "H" is inputted to the port $P_2$ thereby to detect whether or not a customer operated selective switches 10A through 10H. To display the fourth digit of the inserted money-amount, the submicrocomputer 5 outputs the segment data from the port $P_0$ with the terminal 0 of the port $P_1$ as the "H". Before that, the "H" is outputted to the terminal 0 of the port $P_0$ to give an operation signal to the selection switch 10A corresponding to the commodity A. Accordingly, when the selection switch 10A is kept depressed in this condition, the "H" is inputted to the port $P_2$ and the microcomputer 5 can detect the operation of the selection switch 10A. However, if the other selection switches 10B through 10H are depressed, the port $P_2$ does not become the "H", because the operation signal is not given to the selection switches. However, the submicrocomputer 5 makes the terminal 0 of the port $P_1$ "H", and outputs the "H" to the terminal 1 of the port $P_0$, while it outputs the third-column segment data from the port $P_0$, to give the operation signal to the selection switch 10B to detect the operation. The submicrocomputer 5 outputs the "H" from the terminals 0 through 7 of the ports $P_0$, while the "H" is sequentially outputted from each of the terminals 0 through 5 of the ports $P_1$, to scan the operation of the selection switches 10A through 10H to store the selected commodity data of one byte, for each bit, showing the operating situation of each selection switch. When the terminal specifying data and the specifying code data for ordering the transmission of the selected commodity data are inputted from the main microcomputer 7, the selected commodity data is transmitted to the main microcomputer 7.

Figure 5:
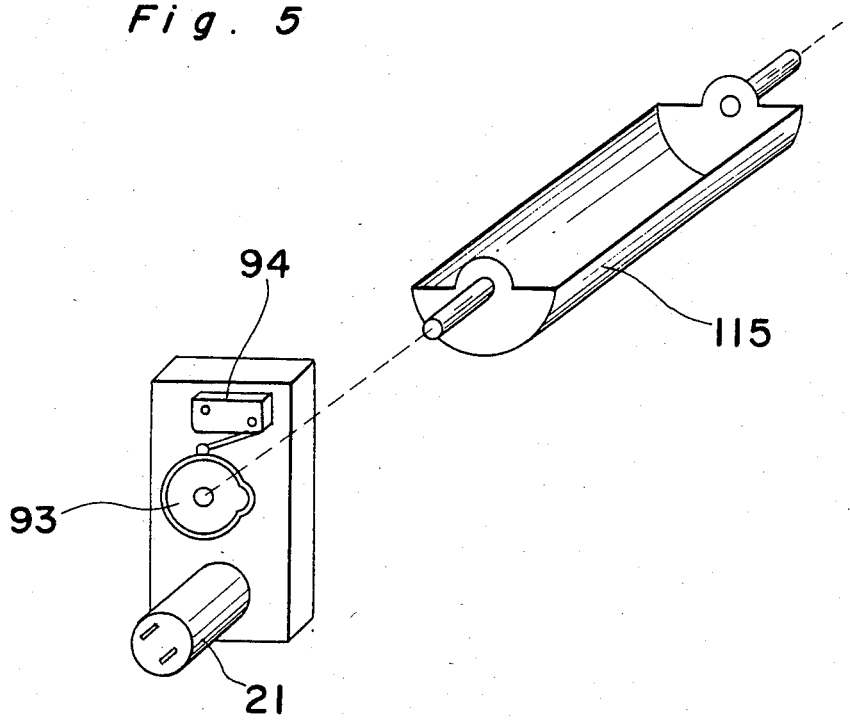
FIG. 5 is an assembly perspective view showing a commodity vending mechanism.

The submicrocomputer 6 of the sales controlling unit 3 normally outputs the "H" to the port $P_3$ to detect the sold-out commodity data from the input signal condition into the terminals 0 through 7 of the ports $P_0$. Once each sold-out switch for each commodity sends back the "H" to the port $P_0$ once the "H" is introduced from the port $P_3$, but can send back the "H" no more when the switching operation is performed due to no-commodity existence. When the "L" shows no-commodity existence by the sold-out commodity data of 8 bits, and the terminal specifying data and the instruction code data for ordering the transmission of the soldout commodity data are inputted from the main microcomputer 7, the sold-out commodity data is transmitted to the main microcomputer 7. Also, when the terminal specifying data, and the instruction code data for ordering the commodity delivery are transferred from the main microcomputer 7, the submicrocomputer 6 performs its commodity delivering operation in accordance with the sales commodity data to be transmitted continuously from the main microcomputer 7. Namely, the submicrocomputer 6 outputs the "H" to the port $P_1$, and outputs the "H" from the terminals 0 through 7 corresponding to the selected commodity of the port $P_0$ to drive the commodity discharging motor thereby to detect, at the port $P_2$, the input signal from the microswitch 94 to be turned off and on through the operative cooperation of the commodity discharging motor by the rotation of the cam 93 as shown in FIG. 5. As in the above-described change payment motor, the microswitch 94 restores, to the "H" again, the output which has become the "L" from the "H" at the rotation start when the commodity discharging motor performs its pivoting operation necessary to deliver one commodity. Accordingly, the submicrocomputer 6 considers the switching operation to the "H" from the "L" of the microswitch output as the completion of the commodity sale to render the output of the port $P_1$ the "L" to stop the commodity discharging motor. On the other hand, the main microcomputer 7 transmits the instruction code data, which orders the transmission of the sales completion data, to the submicrocomputer 6 after the transmission of the sales commodity data. The sales completion data shows the completion of the sales. In the present embodiment, the submicrocomputer 6 is adapted to transmit, to the main microcomputer 7, the output data of the microswitch 94 when the instruction code data is transferred. Accordingly, when the received data from the submicrocomputer 6 through the transmission of the instruction code data shows the "L" of the microswitch output, the main microcomputer 7 confirms that the commodity delivering operation is on to transmit the specifying code data again. However, when the microswitch output has been switched from the "L" to the "H", the instruction code data is transferred from the main microcomputer 7 so that the submicrocomputer 6 transmits to the main microcomputer 7 the data showing the "H" of the microswitch output. And the main microcomputer 7 considers the data as the sales completion code to detect the completion of the sales.

Figure 13:
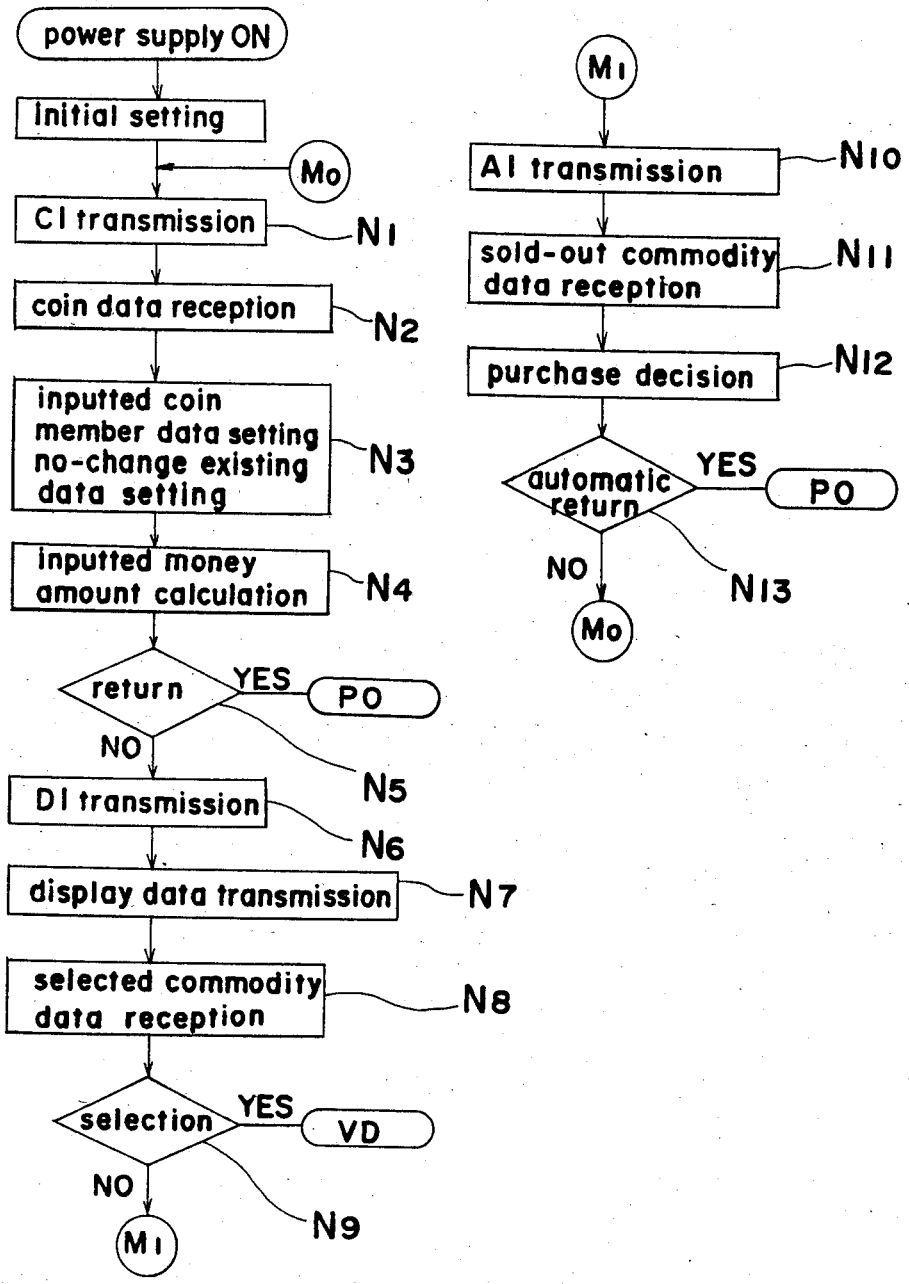
FIG. 13 is a flow chart for explaining the operation of the main microcomputer.

FIG. 13 shows the operation flow chart of the main microcomputer 7, which performs its central controlling operation of the automatic vending machine. The main microcomputer 7, when a given initial setting is completed after the power supply has been put to work, transmits a controlling data C1, composed of the terminal specifying data and the instruction code data for ordering the transmission of the data, to the submicrocomputer 4 at the $N_1$ step, replies it to and reads the coin data, sampling the coin data, at the $N_2$ step, to be transmitted from the submicrocomputer 4. The coin data is composed of the inserted coin data, the no-change data, the return data of each of the coin kinds. The main microcomputer 7 sets, at the $N_3$ step, the inserted coin data, the no-change data of each of the coin kinds, and calculates, at the $N_4$ step, the inputted money-amount to set it in accordance with the inserted coin data. Whether or not the customer operated the return switch 14 is detected at the $N_5$ step by the return data. When the return switch is operated, it moves to the subroutine PO of the coin payment. However, when the return switch 14 is not operated, at the $N_6$ step, the controlling data D1, composed of the instruction code data showing the reception of the terminal specifying data and the display data, and the transmission of the selected commodity data, is transmitted. Thereafter, at the $N_7$ step, the inserted money-amount display data, the purchasable commodity data, the sold-out commodity data are sequentially transmitted. Then, at the $N_8$ step, the selected commodity data transmitted from the submicrocomputer 5 is sampled. When either bit of the selected commodity data of one byte is detected to be the "H" at the $N_9$ step, it moves to the subroutine VD of the commodity sale as the operated selection switch. When the selection switch is not operated, at the $N_{10}$ step, the main microcomputer 7 transmits the controlling data A1, composed of the instruction code data for ordering the transmission of the terminal specifying data and the sold-out commodity data, is transmitted to the submicrocomputer 6. At the $N_{11}$ step, the sold-out commodity data to be transmitted from the submicrocomputer 6 is sampled. And at the $N_{12}$ step, the main microcomputer 7 decides the purchasable commodity in accordance with the inputted money-amount (or the remainder after the sale), the selling price of each commodity stored in the inner memory in advance, the no-change existing data, the sold-out commodity data. Then, at the $N_{13}$ step, the main microcomputer 7 checks the requirement of the automatic refundment, and it moves to the subroutine PO when the automatic refundment is necessary. As the automatic refundment, there are two ways, change payment in a case where no purchasable commodities can be bought for the remainder after the sale, and excess-money-amount return in a case where the inserted money-amount is beyond the maximum inserted money-amount. When the refundment is not required, it is restored to the Mo. Accordingly, in the condition except for during the coin payment or during the commodity sale, the main microcomputer 7 repeatedly executes such main flow to calculate the inserted money-amount, to decide the purchasable commodity to transmit the display data to the front panel controlling unit, and to receive the selected commodity data.

Figure 14:
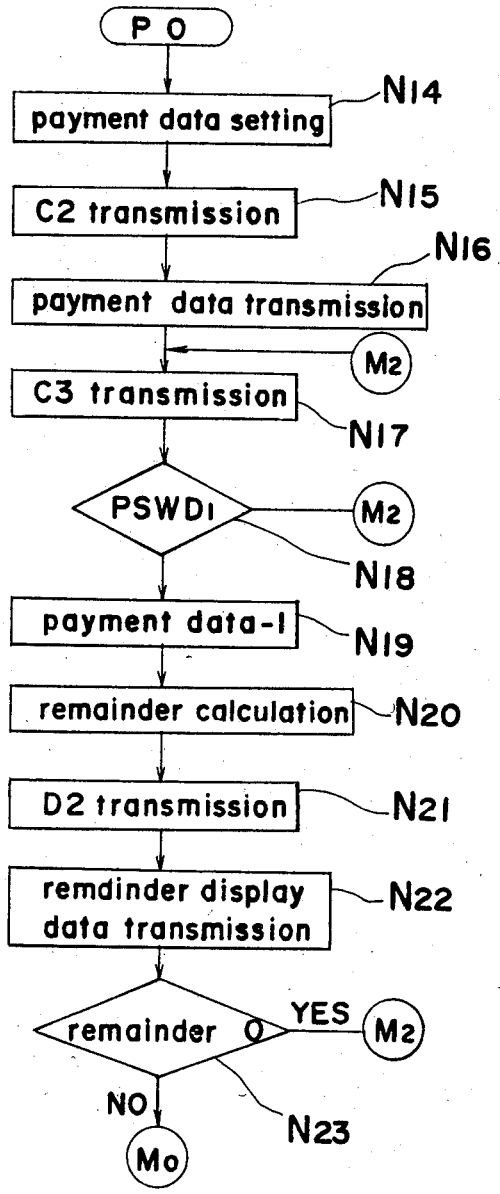
FIG. 14 is a flow chart for explaining the subroutine of coin payment by the operation of the main microcomputer.

FIG. 14 is the subroutine PO of the coin payment. The main microcomputer 7, which decides the inserted money-amount to be refunded, the change amount or the payment coin kind of the excess amount of the maximum inserted amount to set the payment data at the $N_{14}$ step, is composed of the instruction code data for ordering the terminal specifying data and the coin payment to the submicrocomputer 4. The payment data is transmitted at the $N_{16}$ step after the controlling data $C_2$ has been transmitted at the $N_{15}$ step. The main microcomputer 7 repeatedly transmits, at the $N_{17}$ step, the controlling data $C_3$, composed of the terminal specifying data and the instruction code data for ordering the transmission of the output data of the microswitch 92 to wait for the transmission of the coin discharging data $PSWD_1$, which shows the "H" of the microswitch output from the microcomputer 4. And the main microcomputer 7 subtracts, at the $N_{19}$ step, the kinds of the coin paid from the payment data by the reception at the $N_{18}$ step of the coin discharging data $PSWD_1$. When the payment coin kinds are plural, the main microcomputer 7 and the submicrocomputer 4 are both programmed to pay with the large-sum coin priority. The main microcomputer 7 subtracts the "1" from the payment data with the large-sum coin priority every time the coin discharging data $PSWD_1$ is inputted. However, the main microcomputer 7 calculates, at the $N_{20}$ step, the remainder in accordance with the payment data provided after the subtraction to set it. The main microcomputer 7 continuously transmits, at the $N_{21}$ step, to the submicrocomputer 5 the controlling data $D_2$ composed of the terminal specifying data and instruction code data for transmitting the remainder display data, and thereafter transmits the remainder display data at the $N_{22}$ step. Accordingly, the submicrocomputer 5 is adapted to control the display of the unpaid amount after the coin payment. And the main microcomputer 7 decides whether or not the remainder has become "O". When the remainder is not "O", the mode restores to the transmission mode of the controlling data C3 to repeat such control. When the remainder becomes the "O", it moves out of the subroutine PO to restore to the MO of the main flow.

Figure 15:
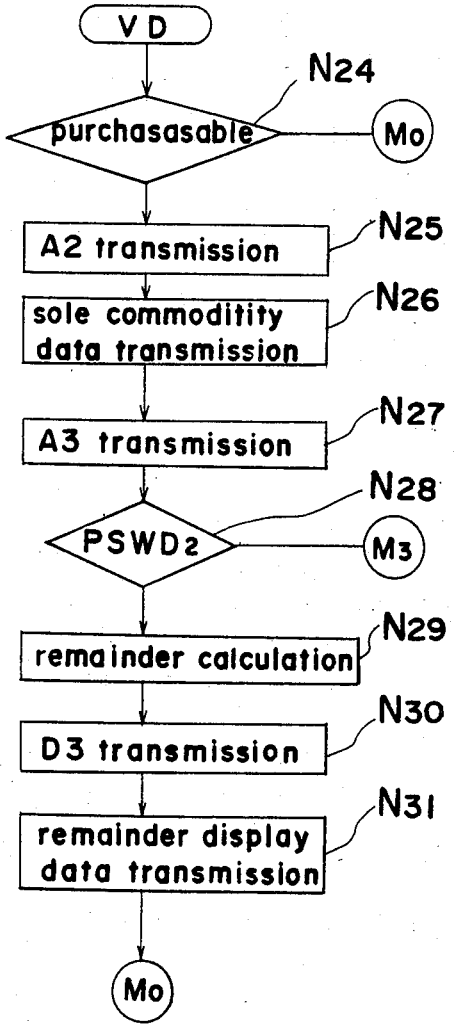
FIG. 15 is a flow chart for explaining the subroutine of the commodity sales by the operation of the main microcomputer.

Also, referring to FIG. 15, the main microcomputer 7 compares the selected commodity data with the purchasable commodity data at the subroutine VD of the commodity sale to decide, at the $N_{24}$ step, whether or not the selected commodity can be purchased. When the commodity cannot be purchased, it restores to the MO of the main flow. However, when the purchase can be made, the main computer 7 transmits, at the $N_{25}$ step, the controlling data A2, composed of the terminal specifying data and the instruction code data for ordering the commodity sale, to the submicrocomputer 6, and furthermore transmits, at the $N_{26}$ step, the sale commodity data. And continuously the main microcomputer 7 transfers, at the $N_{27}$ step, the controlling data A3, composed of the terminal specifying data and the instruction code data for ordering the transmission of the output data of the microswitch 94 to wait from the transmission of the sale completion data $PSWD_2$ showing the "H" of the microswitch output from the submicrocomputer 6. The selected commodity is sold and the sale completion data $PSWD_2$ is transmitted. Once it is detected at the $N_{28}$ step, the main microcomputer 7 subtracts, at the $N_{29}$ step, the sale commodity amount from the inserted money-amount (or the remainder after the sale) to set the remainder. Thereafter, the main microcomputer 7 transmits, at the $N_{30}$ step, the controlling data D3, composed of the terminal specifying data and the instruction code data for transmitting the remainder display data after the sale, to the submicrocomputer 5. Continuously, the main microcomputer 7 transmits, at the $N_{31}$ step, the remainder display data and, then, it restores to the MO of the main flow. Accordingly, the submicrocomputer 5 performs the display controlling operation after the commodity sale.

Also, the submicrocomputer 5 connects the customer operation test switch 43 to the input port P3, the submicrocomputer 4 are the coin processing test switch 44 connected to the input port $P_3$, and the submicrocomputer 6 connects the sale test switch 42 to the input port $P_4$. Each of the submicrocomputers 4, 5, 6 separates from the control of the main microcomputer 7 by the operation of the corresponding test switches 44, 43, 42 to execute the original test sequence programmed in advance. First, the test switch 44 of the coin mechanism controlling unit 1 is operated. When either of the controlling data C1, C2, C3 is transferred in response to the processing from the main microcomputer 7, the submicrocomputer 4 transfers the code showing the test sequence to the main microcomputer 7 in response to it. After the transferring operation, the submicrocomputer 4 stops the normal processing to execute the program of the self check. Also, the main microcomputer 7 detects the entry into the test sequence of the main microcomputer 7. At the test sequence, the coin mechanism controlling unit 1, when the tester inserts a coin, drives the change payment motors 17, 18, 19, 20 corresponding to the coin kinds to pay one coin and comes to a stop. Thus, the tester can confirm the something unusual of the coin detection unit 12, the change payment motors 17, 18, 19, 20, the microswitch and the signal harness. Namely, in the case of something unusual, the failure can be confirmed through no-payment of the coin. And when the tester retores the test switch 44 to its original position at the test completion, things are restored to the normal operation. When the main microcomputer 7 under this condition transfers either of the controlling data C1, C2, C3 in accordance with the processing, the main microcomputer 7 detects the completion of the test sequence so that the submicrocomputer 4 performs the normal response action.

Figure 16:
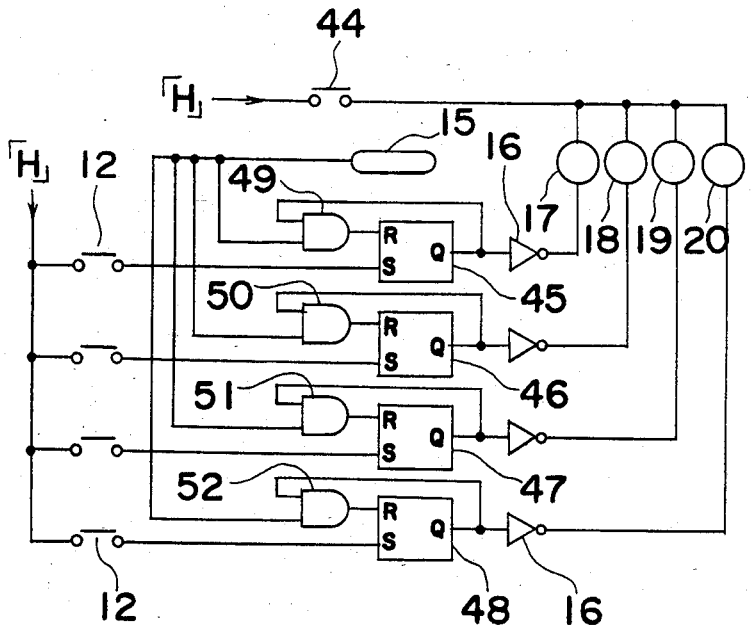
FIG. 16 is a function block diagram for explaining the test operation of the submicrocomputer provided on the coin mechanism control unit.

FIG. 16 is a function block diagram for describing the operation in a case where the submicrocomputer 4 processes the self-check on the coin mechanism controlling unit 1. Referring to FIG. 16, the setting terminal S of the flip-flop circuits 45, 46, 47, 48 are connected with each of the coin detecting units 12 for 10 yen, 50 yen, 100 yen, 500 yen. AND gates 49, 50, 51, 52, to which the input signal from the common input terminal 15 by each of the pulse switches, which operatively cooperate with the change payment motors 17, 18, 19, 20, and the Q outputs of the flip-flop circuits 45, 46, 47, 48 are inputted, are connected with the resetting terminal R. When the test switch 44 is operated, and the tester inserts 10 yen, the flip-flop circuit 45 is set and the change payment motor 17 is driven. And the output of the corresponding microswitch is switched from the "H" to the "L". When the "H" is outputted again by the payment of one coin, the output is provided at the AND gate 49. The flip-flop circuit 45 is reset and the change payment motor 17 comes to a stop. Similarly, even when 50 yen, 100 yen or 500 yen has been inserted, the corresponding change payment motors 18, 19, 20 are driven to pay the coin of the same kind. The test sequence on the coin processing is completed by the restoring operation of the test switch 44.

When the test switch 40 of the automatic restoring type of the front panel controlling unit 2 is operated, the submicrocomputer 5 replies to it, at the time that either of the controlling data D1, D2, D3 is transferred in response to the processing from the main microcomputer 7, to transfer the code showing the test sequence to the main microcomputer 7. However, the submicrocomputer 5 stops the normal processing to execute the program of the self check of the front panel controlling unit 2. The main microcomputer 7 detects the entry of the test sequence by the submicrocomputer 5. At the test sequence, the front panel controlling unit 2 sequentially lights, for each of the commodity kinds, simultaneously a pair of purchasable commodity display LED and the sold-out commodity display LED corresponding to the commodity kinds in the purchasable commodity display 8 and the sold-out commodity display 9, and thereafter displays a given test pattern in each digit of the inserted money-amount display 80. Thus, the tester can confirm anything unusual of each display and the signal harness. And the main microcomputer 7 transfers either of the controlling data D1, D2, D3, after the display completion, in response to the processing, the main microcomputer 7 detects the completion of the test sequence so that the submicrocomputer 5 may perform the normal response action.

Figure 17:
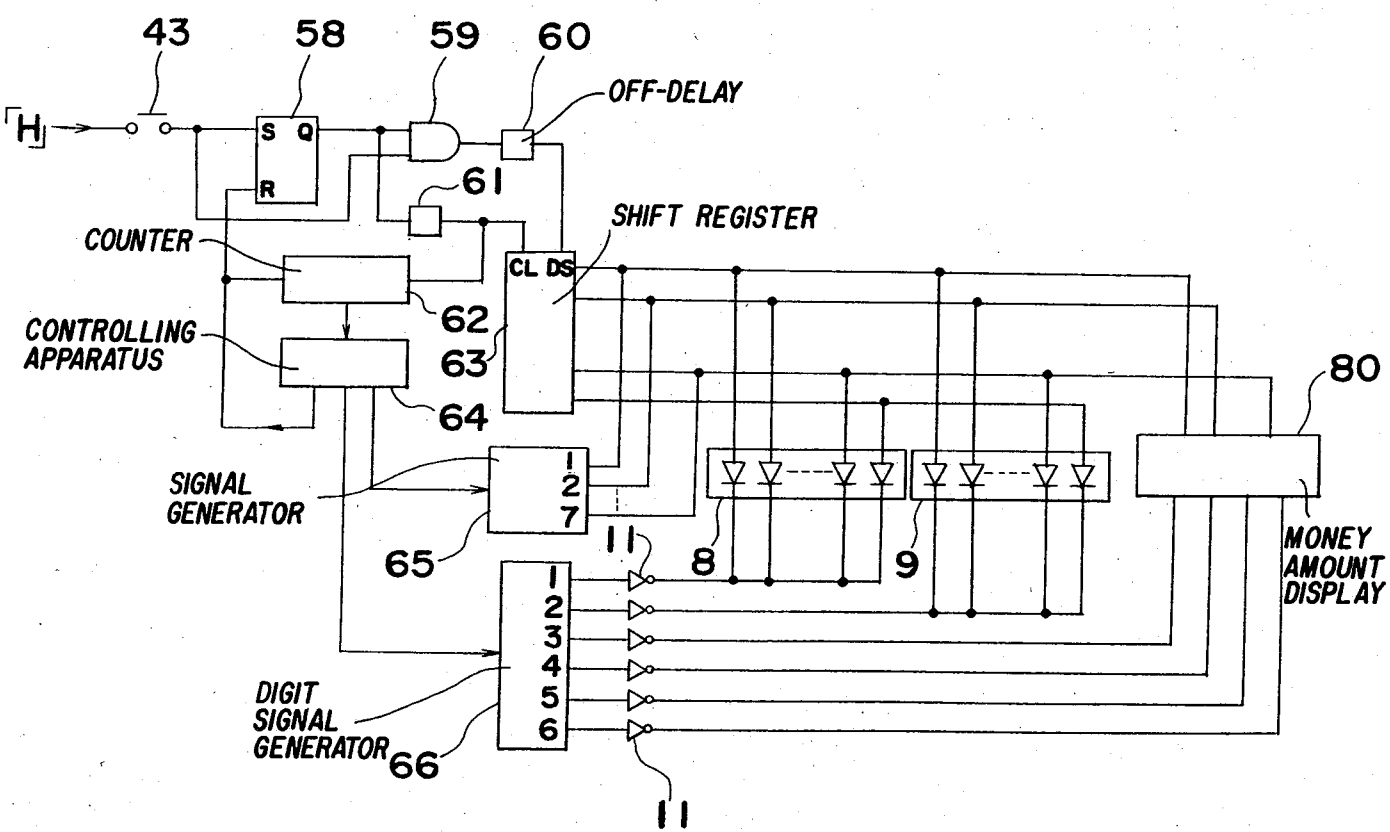
FIG. 17 is a function block diagram for explaining the test operation of the submicrocomputer provided on a front panel control unit.
Figure 18:
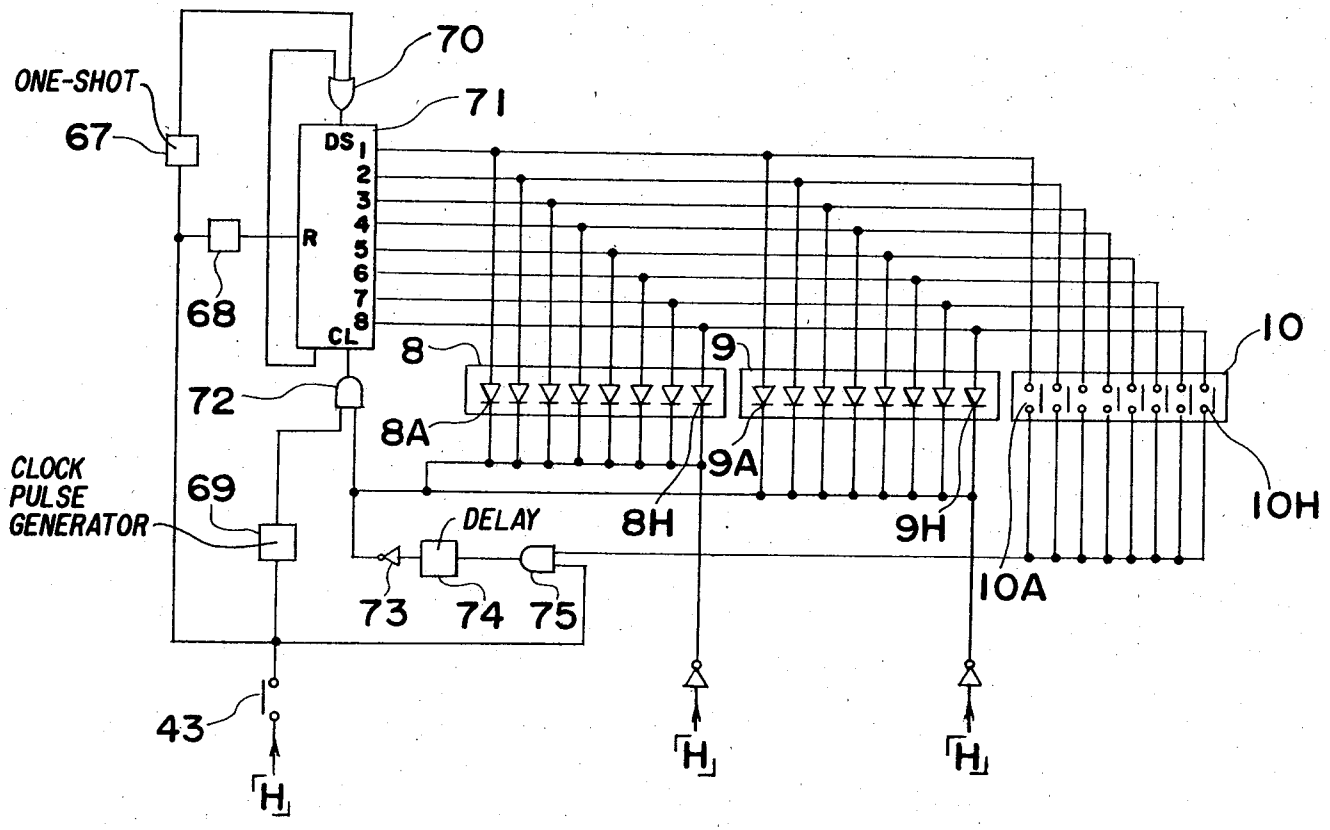
FIG. 18 is a function block diagram for explaining the other test operation of the submicrocomputer provided on the front panel control unit.

FIG. 17 is a function block diagram for explaining the operation in a case where the processing of the self check on the front panel controlling unit 2 is performed by the submicrocomputer 5. Referring to FIG. 17, the flip-flop circuit 58 is set by the operation of the test switch 43. Each of the output terminals of the shift register 63 of 8 bits is connected with a pair of purchasable commodity display LED and sold-out commodity display LED, for each of the commodity kinds, in the purchasable commodity display 8 and the sold-out commodity display 9 and furthermore is connected with the segment signal input terminal of the inserted money-amount display 80. And an off-delay circuit 60 is connected with the data input terminal DS of the shift register 63, while a clock-pulse generating circuit 61 is connected with the clock input terminal CL. In addition, the clock pulse generating circuit 61 is connected with a counter 62. A test controlling apparatus 64 is adapted to output controlling signals to a test pattern signal generating apparatus 65 and a digit signal generating apparatus 66 in accordance with the contents of the counter 62, and to output resetting signals to the counter 62 and the flip-flop circuit 58. Also, the test pattern signal generating apparatus 65 is connected with seven signal wires, which connects each output terminal of the shift register 63 with each display. During the testing operation, the test pattern signal generating apparatus 65 is adapted to output the segment signals of the pattern displayed by the inserted money-amount display 7. And the digit signal generating apparatus 66 is connected with each display through the driver 11. Once the flip-flop circuit 58 is set by the operation of the test switch 43 under such construction as described hereinabove, the output is provided at the AND gate 59. The off delay circuit 60 outputs the "H" to the data input terminal DS of the shift register 63. The off delay circuit 60 outputs the "H" to the data input terminal DS for a given time after the automatic restoration of the test switch 43. The clock pulse generating circuit 61 is operated through the setting operation of the flip-flop circuit 58. The shift register 63 is shifted due to the introduction of the shift pulse into the clock input terminal CL thereby to store the "H" of the data input terminal DS. Also, the counter 62 counts the clockpulses, but the test controlling apparatus 64 outputs the controlling signals so that a digit signal generating apparatus 66 may output the "H" from the output terminals 1, 2 until the counter 62 counts the "9". Accordingly, the first LEDs of the purchasable commodity display 8 and the sold-out commodity display 9 are lit at the same time. Thereafter, whenever the shift register 63 is shifted due to the generation of the clock pulses, a set of LEDs of second and subsequent purchasable commodity display 8 and the soldout commodity display are sequentially lit. However, when the ninth clock pulse is generated, the shift register 63 clears due to one round of memory so that the lighting of the purchasable commodity display 8 and the sold-out commodity display 9 are over. However, the test controlling apparatus 64 outputs the controlling signal so that the "H" may be outputted from the output terminals 3, 4, 5, 6 to the digit signal generating apparatus 66 when the counter 62 counts the "9", and outputs the controlling signal so that the segment signal of the test pattern may be generated in pattern signal generating apparatus 65. One of the simplest test patterns is to lighten each of the segments of all the digital displays 76, 77, 78, 79 to display the "8". The test pattern signal generating apparatus 65 at this time outputs the "H" to all the output terminals of 1 through 7 to display the "8" in each of the digits. Also, the test pattern signal generating apparatus 65 can output the segment signals corresponding to each numeral by the time slicing to cause "0" through "9" to perform the sequential displaying operation. And when the counter 62 counts the given value, the test controlling apparatus 64 outputs the resetting signals to the flip-flop circuit 58 and the counter 62 to finish the test sequence. Also, the purchasable commodity display LED and the soldout commodity display LED of the corresponding commodities are sequentially lightened automatically for each of the commodity kinds by the above-described test operations. The corresponding purchasable commodity display LED and the sold-out commodity display LED may be lightened in response to the operations of the commodity selection switches 10A through 10H. Thus, the tester can confirm things unusual of the purchasable commodity display 8, the sold-out commodity display 9, including the commodity selection switch circuit 10, and of the signal harness in the environs thereof. FIG. 18 is a function block diagram for explaining the operation of lighting the purchasable commodity display LED and the sold-out commodity display LED, by the submicrocomputer 5, corresponding to the operated commodity selection switches 10A through 10 H in the test sequence. When the test switch output is switched from the "L" to the "H" by the operation of the test switch 43, a one-shot circuit 67 introduces the pulse to the data terminal of the shift register 71 through an OR gate 70. The clock pulse generating circuit 69 outputs the clock pulse by the ON of the test switch 43. At this time, as the output side of the inverter 73 is the "H", the clock pulse is introduced to the clock inputting terminal CL of the shift register 71 through the AND gate 72. Accordingly, the shift register 71 stores the "H" of the data terminal DS. Thereafter, every time the clock pulses are inputted, the shifting operation is performed to retain the memory. At a time point a second clock pulse is generated, the one-shot circuit 67 already stops its output. And after one round of the memory, the data is introduced into the data input terminal DS again through the OR gate 70. The data is circuited to and retained in the shift register 71. Accordingly, every time the shift register 71 shifts, each of the output terminals from 1 through 8 sequentially outputs the "H". Operate the commodity selection switch 10A when the "H" is produced from the output terminal 1 by the shift register 8, and the output is provided at the AND gate 75 so that the delaying circuit 74 outputs the "H" for a given period. As the output side of the inverter 73 becomes the "L", the clock pulse introduction to the clock input terminal CL is prohibited by the AND gate 72. Accordingly, the "H" output from the output terminal 1 of the shift register 71 is retained. As the output side of the inverter 73 at this time is the "L", the purchasable display LED 8A and the sold-out display LED 9A are lit. When the output of the delaying circuit 15 becomes the "L", the output side of the inverter 73 becomes the "H" again. The purchasable displays 8A through 8H, and the sold-out displays 9A through 9H are not lit. The clock pulse is introduced through the AND gate 72 to the clock input terminal CL and the shift register 71 shifts. When the commodity selection switches 10A through 10H corresponding to the output terminals are operated along the data shift of the shift register 71, the corresponding purchasable displays LED 8A through 8H and the sold-out displays LED 9A through 9H are lit for the delay time through the delaying circuit 74. Turn off the test switch 43 after the completion of the test, and the resetting signal is generated in the resetting circuit 68 due to the switching operation from the "H" of the test switch output to the "L". Also, as the clock pulse generating circuit 69 becomes inoperative and the output from the test switch 43 to the AND gate 75 becomes the "L", the test controlling operation stops. Also, the submicrocomputer 5 detects the completion of the test operation, because the "L" is introduced into the portion $P_3$, and the normal controlling operation is performed with respect to the front panel unit.

Once the test switch 42 of an automatic restoring type of the sale controlling unit 3 is operated, the submicrocomputer 6 transfers to the main microcomputer 7 a code showing the test sequence in response to the transfer, from the main microcomputer 7, of either of the controlling data A1, A2, A3 in accordance with the processing. Thereafter, the submicrocomputer 6 stops the normal processing to carry out the program of the self-check of the sale controlling unit 3. The main microcomputer 7 detects the entrance of the submicrocomputer 6 into the test sequence. In the test sequence, the sale controlling unit 3 sequentially drives the commodity discharging motors 21A through 21H for each of the commodity kinds to deliver the commodities one by one. The tester can confirm things unusual of the commodity discharging motors 21A through 21H, the microswitch, the signal harness. Namely, in the case of the failure, things unusual can be confirmed by the non-discharging-operation of the ordinary commodities. After the discharging operation of the ordinary commodities, the main microcomputer 7 transfers either of the controlling data A1, A2, A3 in accordance with the processing, and the submicrocomputer 6 operates the normal response operation. Thus, the main microcomputer 7 detects the completion of the test sequence.

Figure 19:
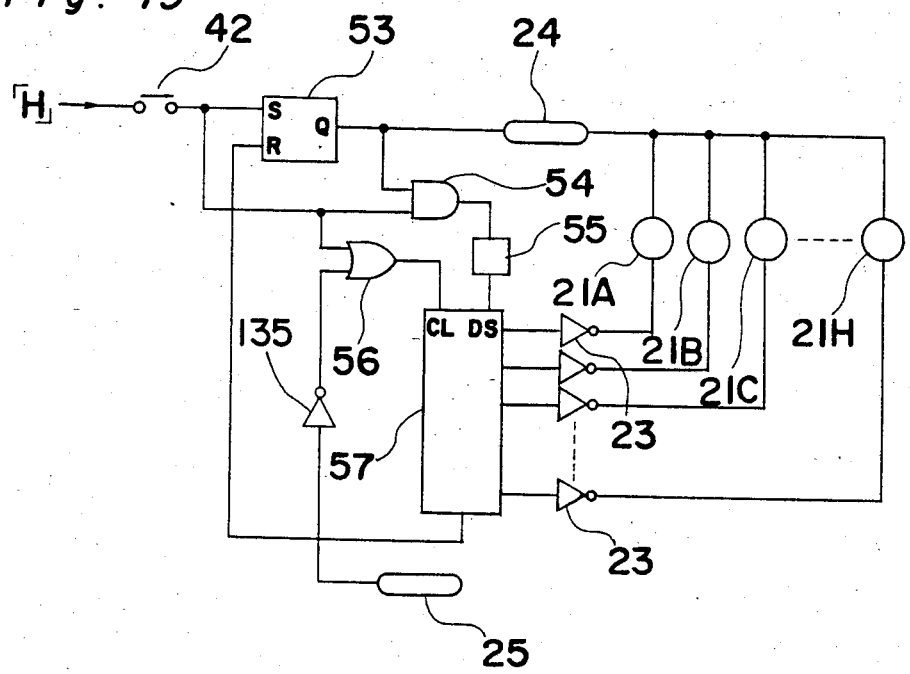
FIG. 19 is a function block diagram for explaining the test operation of the submicrocomputer provided on a sales control unit.

FIG. 19 is a function block diagram for explaining the operation in a case where the self-check operation on the sale controlling unit 3 is effected by the submicrocomputer 6. Referring to FIG. 19, when the flip-flop circuit 53 is set by the operation of the test switch 42, a driving signal is fed to the commodity discharging motors 21A through 21H through the common output terminal 24 by the operation of the test switch 42. And the output terminals of the shift register 61, of 8 bits, corresponding to the commodity kinds are connected, respectively, to the commodity discharging motors 21A through 21H through the driver 23. Also, the off delay circuit 55 is connected with the data input terminal DS of the shift register 57. The clock input terminal CL of the shift register 57 is connected through an inverter 135 with the common input terminal 25 of each microswitch, which operatively cooperates with the test switch 42 and the commodity discharging motors 21A through 21H through the OR gate 56. When the flip-flop circuit 53 is set by the operation of the test switch 42 under such construction as described hereinabove, the driving signal is fed to each of the commodity discharging motors 21A through 21H through the common output terminal 24. And the AND gate 54 causes its output through the setting output of the flip-flop circuit 53 and the operating output of the test switch 42. The off delay circuit 55 outputs the "H" at the data input terminal DS of the shift register 57. It is to be noted that the off delay circuit 55 outputs the "H" at the data input terminal DS for a given time after the automatic restoration of the test switch 42. On the other hand, the test switch 42 of automatic return type is actuated to output the "H" and, then, is automatically returned to output the "L", the fall signal disposed between the "H" and "L" is introduced, as a shift pulse, into the clock input terminal CL of the shift register 57 through the OR gate 56. Accordingly, the commodity discharging motor 21A is driven so that the shift register 57 stores the "H" of the data input terminal DS. And the output of the microswitch, which operatively cooperates with the commodity discharging motor 21A is switched from the "H" to the "L" at the driving start of the motor and the output of the inverter 135 is switched from the "L" to the "H" to deliver the commodity. When the output of the inverter 135 is restored to the "L" from the "H", the shift register 57 is shifted up due to the falling from the "H" of the inverter 135 output to the "L". When the commodity discharging motor 21B starts its driving operation and the inverter 135 outputs the "L" from the "H", the shift register 57 is shifted up so that the commodity discharging motor 21C starts its driving operation. When the shift register 57 is shifted up every time the input signal of the common input terminal 25 is switched to the "H" from the "L", the commodity discharging motors 21A through 21H are sequentially driven. When the microswitch, which operatively cooperates with the commodity discharging motor 21H, outputs the "H" from the "L", the shift register 57 causes its carry output. The carry output resets the flip-flop circuit 53 to complete the test sequence.

Figure 12:
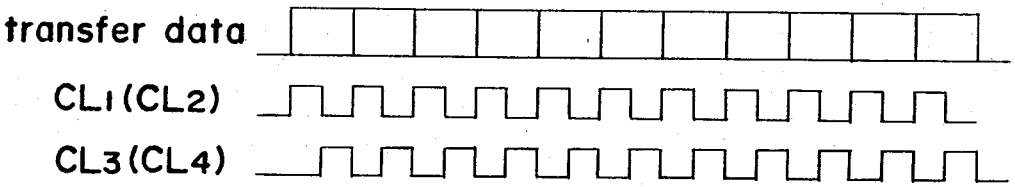
FIG. 12 is a timing chart for explaining the timing of the data transfer.
Figure 20:
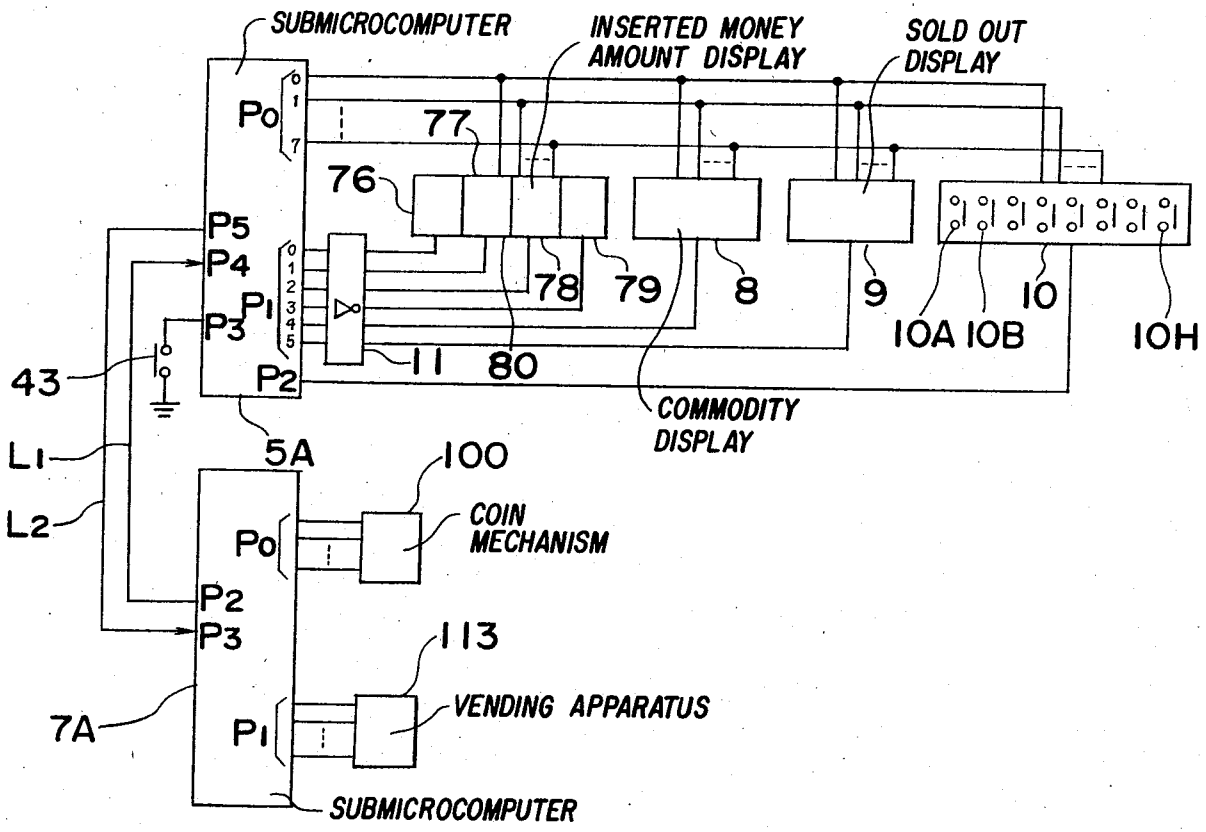
FIG. 20 is a control circuit diagram of an automatic vending machine in a case where the submicrocomputer is provided only in the front panel control unit.
Figure 21:
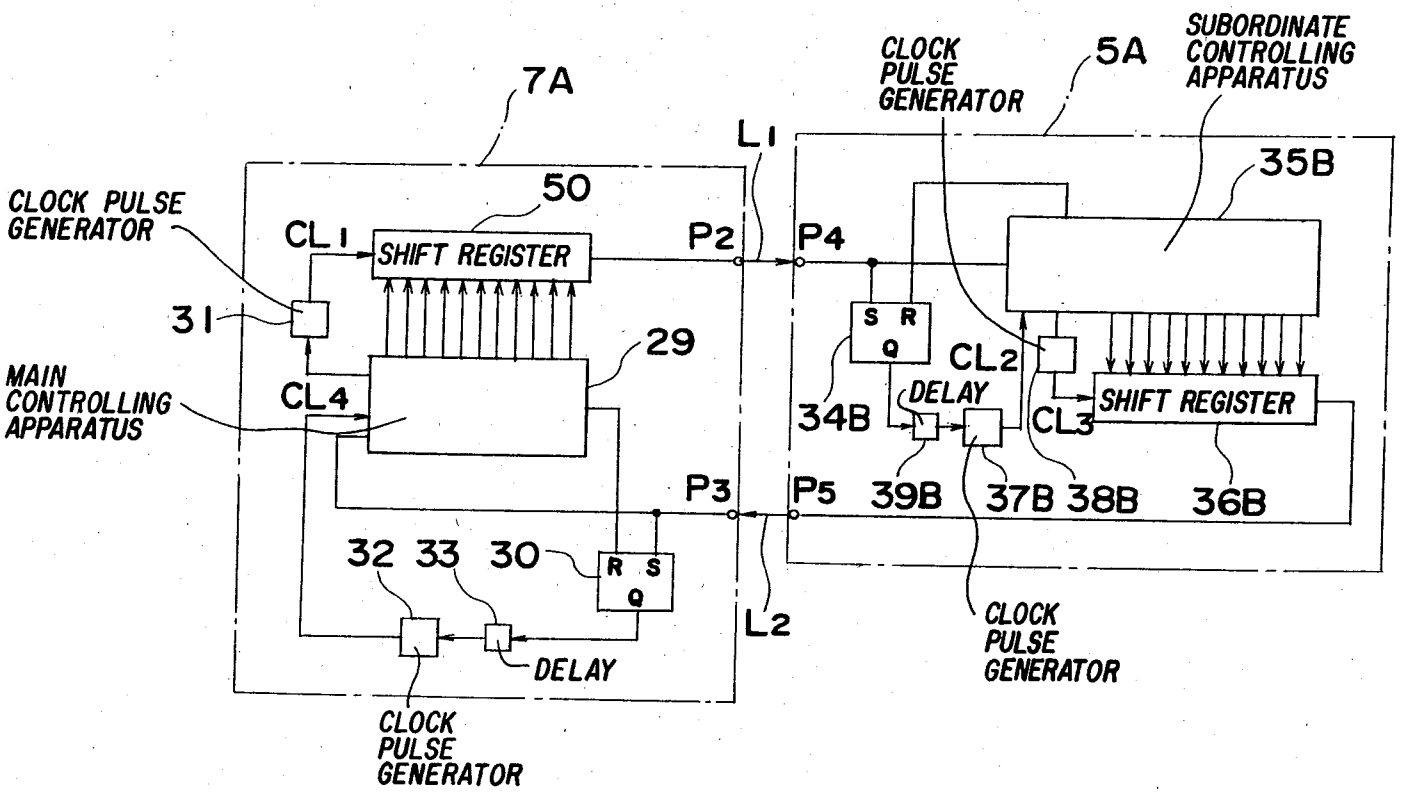
FIG. 21 is a function block diagram for explaining the operation in a case where the main microcomputer and the submicrocomputer transmit and receive the data by two signal wires.

FIG. 20 shows an example wherein the controlling operation of the coin mechanism 100 and the vending apparatus 113 are directly performed through the port $P_0$ and the port $P_1$ by the main microcomputer 7A and the submicrocomputer 5A is provided in the front panel unit 111. In this example, the main microcomputer 7A is connected with the submicrocomputer 5A by two signal wires $L_1$, $L_2$. The port $P_2$ of the main microcomputer 7A and the port $P_4$ of the submicrocomputer 5A are set, respectively, in the data transmission terminal and the data reception terminal, and are connected with each other by the signal wire $L_1$. The port $P_3$ of the main microcomputer 7A and the port $P_5$ of the submicrocomputer 5A are set, respectively, in the data reception terminal and the data transmission terminal, and are connected with each other by the signal wire $L_2$. FIG. 21 is a function block diagram for explaining the operations of the main microcomputer 7A and the submicrocomputer 5A in a case where the data transmission is performed with two signal wires. The same reference numerals are given to the same functional objects as in the main microcomputer 7 and the submicrocomputer 5 in FIG. 11. In FIG. 21, no both-direction switching gates 40, **41*b* exist, the setting terminals of the flip-flop circuits 30, 34B are connected with the ports $P_3$, $P_4$, the output stages of the shift registers 50, 36B are connected with the ports $P_2$, $P_5$. FIG. 12 is different, in the above-described point, from FIG. 11. The data transferring operation between the main microcomputer 7A and the submicrocomputer 5A under such function construction as described hereinabove starts through the transmission of the instruction code data by the microcomputer 7 in the same manner as described in FIG. 11. According to the description of FIG. 11, the terminal specifying data, together with the instruction code data, is transmitted. However, in the present embodiment, only the submicrocomputer 5A is provided in relation to the main microcomputer 7A. Thus, no terminal specifying data is not required in particular. The ports $P_2$, $P_3$, $P_4$, $P_5$, are terminals for reception and transmission use, are the mark condition "H". After the main controlling apparatus 29 has set the transfer data of 11 bits in the shift register 50, the clock pulse generating circuit 31 is operated and the clock pulse $CL_1$ is introduced to the shift register 50. The "L" of the start bit is outputted from the port $P_2$ for transmission use. The flip-flop circuit sets in the falling of the "L" from the "H" of the ports $P_4$ for reception use. After the setting of the flip-flop circuit 34B, the clock pulse generating circuit 37B operates delayed by the delay circuit 39B to output the clock pulse $CL_2$, which lags the clock pulse $CL_1$ by a phase difference of 180°. The subordinate controlling apparatus 35B reads the data to be inputted for the reception use in synchronous relation with the rising of the clock pulse $CL_2$. Accordingly, the subordinate controlling apparatus 35B samples such data at the respective $\frac{1}{2}$ bit timing as shown in FIG. 12, and reads it. Thereafter, the subordinate controlling apparatus 35B completes the sampling of the transfer data of 11 bits to output the resetting signal to the flip-flop circuit 34B** to complete the transfer of the instruction code data.

And the subordinate controlling apparatus 35B decodes the transferred instruction code data to make out that it orders the reception of the data, the flip-flop circuit 34B sets by the start bit of 11 bit data to be transmitted from the main microcomputer 7A to sample the data in synchronous relation with the clock pulse $CL_2$. Also, the subordinate apparatus 35B makes out the transferred instruction code data orders the transmission of the data to set the transfer data in the shift register 36B thereby to operate the clock pulse generating circuit 38B. Accordingly, the clock pulse $CL_3$ is introduced to the shift register 36B and the transfer data is sequentially outputted from the ports $P_5$ for transmission use as shown in the format of FIG. 10 described above. The flip-flop circuit 30 is set by the "L" of the start bit. Also, the clock pulse generating circuit 32 operates later than the setting of the flip-flop circuit 30 by the delay circuit 33, and outputs the clock pulse $CL_4$, which lags the clock pulse $CL_3$ by a phase difference of 180° as shown in the timing chart of FIG. 12. However, the main controlling apparatus 29 samples the data, at the respective $\frac{1}{2}$ bit timing, to be inputted to the port $P_3$ for reception use in synchronous relation of the rising of the clock pulse $CL_4$ to read it. After the completion of the sampling of the data of 11 bits, the resetting signal is outputted to the flip-flop circuit 30 to complete the data transfer to the main microcomputer 7A.

The operation and function of such submicrocomputer 5A shown in FIG. 20 are completely the same as those of such submicrocomputer 5 as shown in FIG. 9. The inserted money-amount display 80, the purchasable commodity display 8, the sold-out commodity display 9 are controlled in display in accordance with the money-amount data, the purchasable commodity data, the sold-out commodity data transferred from the main microcomputer 7A. The operation detection of the commodity selection switches 10A through 10H is periodically performed to transmit the selected commodity data in accordance with the demand of the main microcomputer 7A. And the main microcomputer 7A achieves the function described in FIG. 13 through FIG. 15. In the present embodiment, no submicrocomputer exists in the coin mechanism 100 and the vending apparatus 113, and thus the operation of each of the steps $N_1$, $N_{10}$, $N_{15}$, $N_{17}$, $N_{25}$, $N_{27}$, which transmits the controlling data $C_1$, $A_1$, $C_2$, $C_3$, $A_2$, $A_3$ is omitted in the flow chart. At the $N_2$ step, the main microcomputer 7A detects the inserted coin signal and the no-change existing signal from the coin mechanism 100. At the next $N_3$ step, the inserted coin-number data and no-change existing data are set. Also, at the $N_{11}$ step, the sold-out commodity is detected by sold-out switches 22A through 22H of the vending apparatus 113 to set the sold-out commodity data. At the $N_{16}$ step, a driving instruction is given to the change payment motors 17, 18, 19, 20 corresponding to the payment coin in accordance with the payment data. At the $N_{18}$ step, the detection of the output of the microswitch, from the "L" to the "H", which operatively cooperates with the driven change payment motor, means the completion of the payment of one coin. At the $N_{26}$ step, a driven instruction is given to the commodity payment motors 21A through 21H corresponding to the selected commodity kinds in accordance with the selected commodity data selected from the submicrocomputer 5A. At the $N_{27}$ step, the detection of the output of the microswitch, from the "L" to the "H", which operatively cooperates with the driven commodity discharging motor, means the completion of the sale of the commodity. However, the main microcomputer 7A executed each step of $N_6$, $N_7$, $N_8$, $N_{21}$, $N_{22}$, $N_{30}$, $N_{31}$, in the flow chart from FIGS. 13 to 15, with respect to the submicrocomputer 5A. But as described hereinabove, the terminal specifying data is not particularly required to be built-in in the controlling data. Also, the submicrocomputer 5A performs the test operations described in FIG. 17 or FIG. 18 by the ON of the test switch 43.

Figure 23:
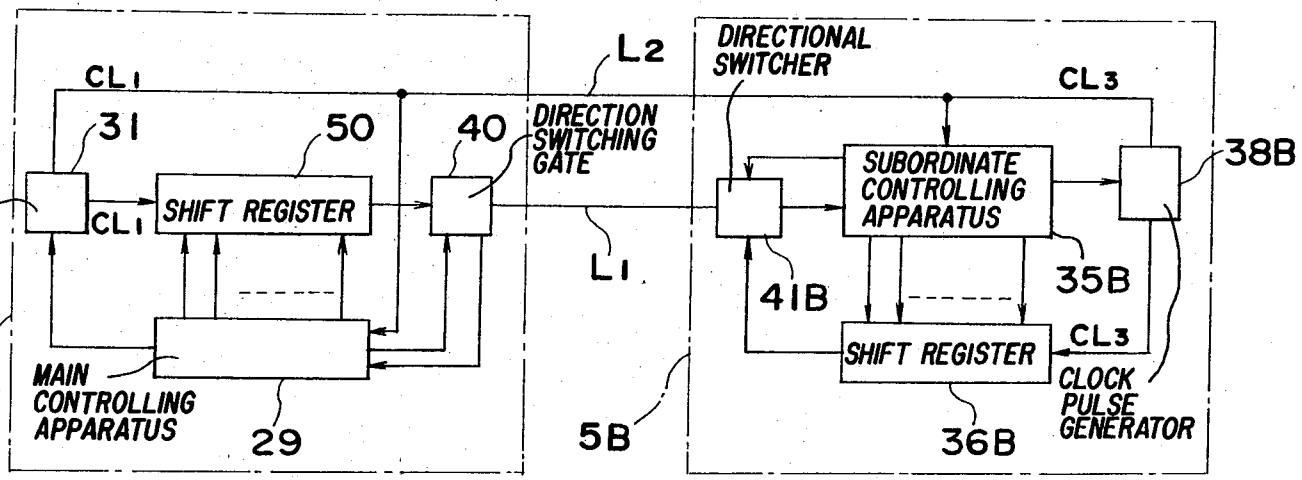
FIG. 23 is a function block diagram for explaining the operation in a case where the main microcomputer and the submicrocomputer transmit and receive the data, in the modified process, by two signal wires.

Also, FIG. 23 shows the other embodiment, wherein the serial transfer of the data is performed between the main microcomputer 7B and the submicrocomputer 5B by two signal wires. In the transfer system of FIG. 23, two signal wires $L_1$, $L_2$ are rendered, respectively, data wire, clock signal wire to transfer the data in synchronous relation with the clock pulse. The data wire $L_1$ is provided between the both-direction switching gates 40, 41B of the main microcomputer 7B and the submicrocomputer 5B. The clock pulse generating circuits 31, 38B are connected with the main controlling apparatus 29 or the subordinate controlling apparatus 35 on the other side through the clock signal wire $L_2$. To transmit the data to the submicrocomputer 5B from the main microcomputer 7B, the main controlling apparatus 29 sets the transmission data to the shift register 50 and puts the switching gate 40 into the transmission readiness. The clock pulse generating circuit 31 is operated to output the data into the data wire $L_1$. The subordinate controlling apparatus 35B samples the data to be introduced through the switching gate 41B in the reception readiness in accordance with the clock pulse $CL_1$ of the clock pulse generating circuit 31 to be introduced through the clock signal wire $L_2$, to receive the data. Also, to transmit the data to the main microcomputer 7B from the submicrocomputer 5B, the subordinate apparatus 35B sets the transmission data to the shift register 36B and puts the switching gate 41B onto the transmission readiness. The clock pulse generating circuit 38B is operated to output the data to the data wire $L_1$. And the main controlling apparatus 29 samples the data to be introduced through the switching gate 40 in the reception readiness in accordance with the clock pulse $CL_3$ of the clock pulse generating circuit 38B to be introduced through the clock signal wire $L_2$ and receives the data.

Figure 24:
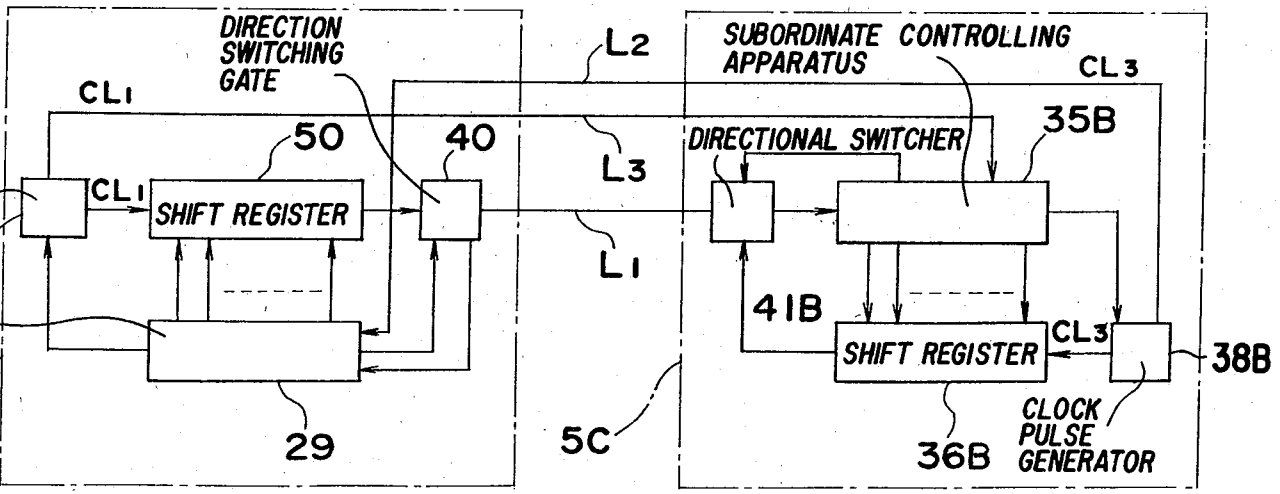
FIG. 24 is a function block diagram for explaining the operation in a case where the main microcomputer and the submicrocomputer transmit and receive the data by three signal wires.

FIG. 24 shows the data transfer system between the main microcomputer 7C and the submicrocomputer 5C by three signal wires. The clock signal wires are rendered two, $L_2$ and $L_3$ under the construction of FIG. 23. One of the clock signal wires is used in the transmission of the clock pulse $CL_1$ from the main microcomputer 7C to the submicrocomputer 5C, while the other thereof is used in the transmission of the clock pulse $CL_3$ from the submicrocomputer 5C to the main microcomputer 7C.

Figure 25:
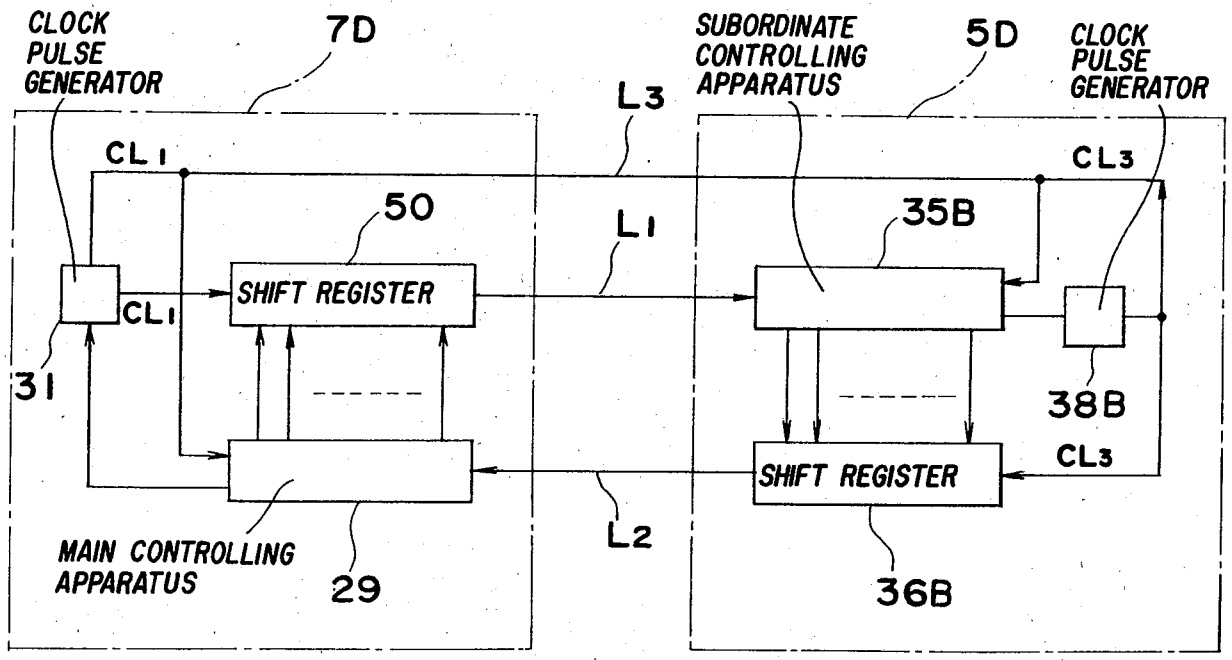
FIG. 25 is a function block diagram for explaining the operation in a case where the main microcomputer and the submicrocomputer transmit and receive the data, through the other method, by wires.

FIG. 25 shows another transfer system by three signal wires. The signal wire $L_1$ is the data transmission wire from the main microcomputer 7D to the submicrocomputer 5D. The signal wire $L_2$ is the data transmission wire from the submicrocomputer 5D to the main microcomputer 7D. The signal wire $L_3$ is the common wire of the clock pulse $CL_1$ or $CL_3$. In this case, the transmission and reception of the data are performed by the respective signal wires. Thus, the switching gates 40, 41B shown in FIG. 24 are not required.

Figure 26:
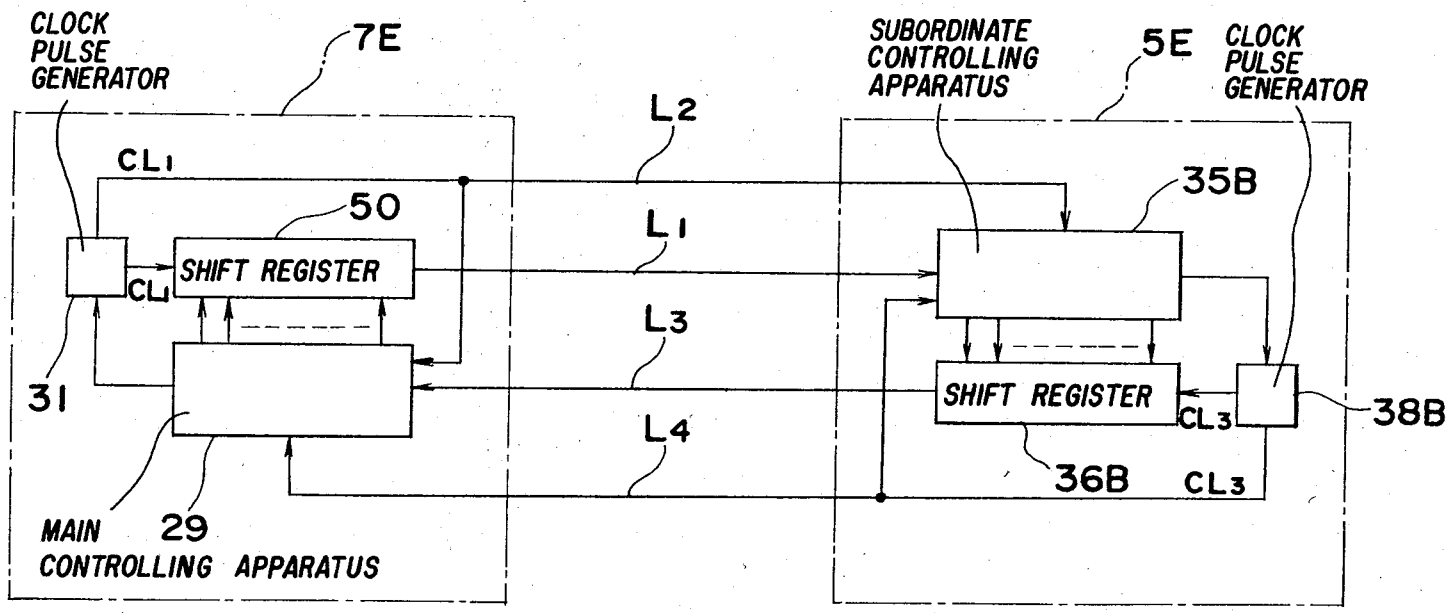
FIG. 26 is a function block diagram for explaining the operation in a case where the main microcomputer and the submicrocomputer transmit and receive the data by four signal wires.

FIG. 26 shows the data transfer system between the main microcomputer 7E and the submicrocomputer 5E by four signal wires. The signal wire $L_1$ is the data transmission wire $L_1$ from the main microcomputer 7E to the submicrocomputer 5E. The signal wire $L_2$ is the transmission wire $L_2$ of the clock pulse $CL_1$. The signal wire $L_3$ is the data transmission wire $L_3$ from the submicrocomputer 5E to the main microcomputer 7E. The signal wire $L_4$ is the transmission wire $L_4$ of the clock pulse $CL_3$. Even in this case, the transmission and reception are performed by the separate signal wires. Thus, the switching gates 40, 41B are not required.

Referring to FIGS. 23 to 26, in each of the above-described transfer systems, the start bit, the stop bit are not required in the transfer format shown in FIG. 10 to transfer the data in synchronous relation with the clock pulse. Accordingly, the shift registers 50, 36B are composed of 8 bits. Referring to FIGS. 23 to 26, the main controlling apparatus 29 counts the clock pulse $CL_1$ for transmission use during the data transmission to the submicrocomputer. When the main controlling apparatus counts "8", the clock pulse generating apparatus 31 is adapted to be rendered inoperative. Also, the subordinate controlling apparatus 35B counts the clock pulse $CL_3$ for transmission use during the data transmission to the main microcomputer. When the subordinate controlling apparatus counts "8", the clock pulse generating apparatus 38B is adapted to be rendered inoperative.

According to the present invention, a main microcomputer for controlling the entire automatic vending operation and a submicrocomputer for the controlling operation on the some restricted function blocks of the automatic vending machine are disposed. Signal wires for serially transmitting the data with respect to each other are disposed between the main microcomputer and the submicrocomputer. The submicrocomputer on the terminal side is adapted to control the components located within the function blocks by the instruction code data to be transmitted from the main microcomputer through the signal wires. Conventionally, in the control-unit base plate of the automatic vending machine, the number of the wirings were extremely increased, because the control-unit base plate was often connected respectively with each of the terminals such as switch, driving unit, display, etc. which were components of the automatic vending machine. However, according to the present invention, the control-unit base plate with the main microcomputer being engaged thereon is connected with the submicrocomputer on the terminal side by the signal wires of a number selected from one to four, thus effectively reducing the number of the wirings of the control-unit base plate.

Accordingly, the control-unit base plate is simplified to improve the assembling efficiency during the manufacturing operation. Also, the signal harness located within the automatic vending machine connecting the control-unit base plate with the terminal side can be considerably reduced in number. The wiring disposition is simplified and the cost required for the wirings can be effectively lowered. Furthermore, the functions which were concentrated on the control-unit base plate are partially dispersed on the terminal side, the operation can be performed with the terminal side being separated from the control-unit base plate. The failures can be easily analyzed through the setting operation of the given test operation. According to the present invention, the controlling functions are provided in the some restricted function blocks of the automatic vending machine so that the controlling unit of the terminal side on the function blocks can be rendered common among the various automatic vending machines. Accordingly, the development and design efficiency are improved. In addition, according to the present invention, the connection conditions of the terminal side controlling unit are standardized, thus simplifying the specification changes and the function increase of the automatic vending machine. Namely, to add the new functions to the automatic vending machine, the submicrocomputer for controlling the new function blocks is provided and is connected with the main microcomputer through already disposed signal wires, and a program for controlling the submicrocomputer is added to the main microcomputer.

Although the present invention has been described and illustrated in detail, it is to be already understood that the same is by way of illustration and example only and is not to be taken by way of limitation, the spirit and scope of the present invention being limited only by the terms of the appended claims.

What is claimed is:

1. A control system for an automatic vending machine for selling a plurality of articles, including a front panel unit having money amount displays, sold-out displays disposed in accordance with kinds of articles to be sold to indicate when said article is sold out, selection switches provided to select a desired article, coin detector for providing an inserted coin signal upon detection of insertion of a proper coin, article delivery apparatus for discharging the selected articles, sold-out switches for detecting whether or not the selected articles are available, change payment means for providing coins for change, and change detectors for detecting whether coins are present for change use, and further comprising:

a main microcomputer for transmitting commands received from said front panel unit, said main microcomputer including:

storage means for storing the price of each article, calculating means for calculating the amount of said inserted money in accordance with said inserted coin signal, means for calculating the amount of money remaining after sale of said article, determining means for determining articles purchasable by customers in accordance with the existence of change detected by said change detector and the existence of said articles detected by said sold-out switches by comparing said inserted money amount with said article prices, controlling means for controlling said article delivery apparatus, and change payment controlling means for controling said change payment unit to pay change due said customer, at most four signal lines for transmission of command data serially from said main microcomputer, a sub-microcomputer for controlling display operation of said money amount display and said sold-out display, and detecting operation of said selection switches coupled to said main microcomputer through said signal lines for communication with said main microcomputer, said sub microcomputer including:

detecting means for detecting operation of said selection switch by a customer to produce selected commodity data representing the types of articles selected by said customer, decoding means for decoding said command data transmitted from said main microcomputer, transmitting/receiver means for transmitting said selected commodity data serially through said signal lines in response to input of a request for command data transmission of said selected commodity data, to said main microcomputer, and for receiving said money amount data and said sold-out data transmitted serially through said signal line from said main microcomputer in response to at least one of said input request for command data transmission in said sold-out data and money amount data, display means for displaying the received money amount data on the money amount display, and display means for displaying on said sold-out commodity display an article which has been sold out according to the sold-out data received, wherein said main microcomputer controls said article delivery apparatus to discharge the selected article when an article which is indicated by said selected commodity data received from said sub-microcomputer and has been selected by the customer is purchasable.

2. The control system for an automatic vending machine in accordance with claim 1, further including:

a test switch coupled to said sub-microcomputer, and said sub-microcomputer further including:

means for lighting and sold-out display by operation of said test switch, and means for displaying a test pattern on said money amount display by operation of said test switch.

3. The control system for an automatic vending machine in accordance with claim 1, further including a test switch coupled to said sub-microcomputer, said sub-microcomputer including means for lighting a corresponding sold-out display in response to operation of said selection switch when said test switch is operated.

4. A control system for an automatic vending machine for selling articles comprising a coin mechanism having a coin detector means for generating an inserted coin signal in accordance with a coin type inserted, change payment unit for paying the same coin type as the coin to be inserted, change detector means for detecting whether or not coins needed for change are available, article delivery means for discharging selected articles, sold-out switch for detecting whether or not articles selected are available, article selection switch provided in accordance with the types of said article, a main microcomputer for transmitting a command with respect to the coin mechanism, said main microcomputer including the following means, memory means for storing the price of each article in accordance with the types of the articles, calculating means for calculating inserted amount from data indicating the inserted coin transmitted from said coin mechanism, memory money amount calculating means for calculating the remaining money amount after the article sale, determining means for determining articles purchasable by customers in accordance with data of the existence of the articles detected by said sold-out switch and of the existence of change remaining, with the data to be transmitted from said coin mechanism upon comparing one of said inserted money amount and said remaining money amount with the price of each article, controlling means for controlling said article delivery apparatus for discharging said selected article when said article is selected through operation of said selection switch by a customer and is purchasable, and means for producing payment data in accordance with said remaining money amount to transmit the data to said coin mechanism, at most four signal lines for serial transmission and reception between said main microcomputer and said coin mechanism of said data indicating existence or non-existence of change, said payment data and said data showing the type of inserted coin, and a sub-microcomputer provided in said coin mechanism for inputting said inserted coin signal produced in said coin detector through the inserting operation of a proper coin by a customer for detecting by said change detector whether or not the change to be paid is available, for controlling the change paying operation of the change payment apparatus, said sub-microcomputer being further connected with said main microcomputer through said signal line for communication with said main microcomputer, said sub-microcomputer further including:

inserted coin detecting means for detecting said inserted coin signal produced in said coin detector to produce the data indicating the type of inserted coin, change detecting means which detect whether or not said change is available according to said change detector to produce data showing existence or co-existence of said change, decoding means for decoding command data transmitted from said main microcomptuer, transmitting/receiving means for transmitting said data to said main microcomputer serially through said signal line in response to input of a request for command data transmission to the main microcomputer, and for receiving serially said payment data from said main microcomputer in response to input of a request for data in said command data indicating inserted money amount and the existence of said change, and change paying controlling means for controlling said change paying apparatus to pay change in accordance with said payment data received.

5. The control system according to claim 4, further including test switch coupled to said sub-microcomputer, said sub-microcomputer including means for controlling said change payment unit to provide the same type of coins as the inserted coins when the inserted coin signal corresponding to the type is produced through the insertion of the coins in the operative condition of the test switch.

6. A control system for an automatic vending machine, comprising:

a vending apparatus having an article delivery apparatus to discharge selected articles, and sold-out switch for detecting in accordance with types of articles whether or not said article is available, a plurality of selection switches provided in accordance with said types of said articles, coin detector for generating an inserted coin signal in accordance with an inserting operation of proper coins, a change detector for detecting existence or non-existence of the available coins for use as change, main microcomputer for transmitting a command with respect to the vending apparatus, the main microcomputer including:

memory means for storing a price of each article in accordance with the types of the articles, calculating means for calculating an inserted money amount in accordance with said inserted coin signal, memory money amount calculating means for calculating money amount remaining after sale of said articles, determining means for determining purchasable articles to customers in accordance with the existence of change indicated by said change detector and sold-out data indicating sold-out articles, to be transmitted from the vending apparatus by the comparing said inserted money amount with said article prices, transmitted means for transmitting to said vending apparatus sale commodity data showing the types of article to be sold if said article selected through the operation of said selection switch by a customer is purchasable, at most four signal lines for serially carrying to and from said main microcomputer and said vending apparatus said command data, said sold-out data and said article data, and a sub-microcomputer in said vending apparatus for controlling article delivery operation of said article delivery apparatus, for detecting whether said article is available in accordance with said sold-out switch, and further is connected to said main microcomputer through said signal line for communication with said main microcomputer, said sub-microcomputer including:

sold out detecting means for detecting said sold-out article in accordance with said sold out switch, command decoding means for decoding command transmitted from said main microcomputer, and transmitting receiving means for serially transmitting sale commodity data to said main microcomputer through said signal line in response to input of command indicating transmission request of said sold-out data to said main microcomputer, and for receiving article data to be transmitted serially from said main microcomputer in response to input of command data instructing a reception request of data.

7. The control system in accordance with claim 6, further including a test switch coupled to said sub-microcomputer, said sub-microcomputer including means which sequentially controls article delivery operation of said article delivery apparatus disposed in accordance with selling-article types by operation of said test switch.

8. A control system, of an automatic vending machine for selling articles, including:

front panel unit having money amount displays, sold-out displays disposed in accordance with article types to display sellout of said articles, and selection switches provided in accordance with said types of said articles, coin mechanism having a coin detector means for selecting an inserted coin to generate an inserted coin signal upon detection of a proper coin, change payment means for paying change for small change use, change detector means for detecting presence of coin needed for change use, vending apparatus having an article delivery apparatus for discharging selected articles and a sold-out switch for detecting whether or not said article is available, customer unit for interfacing with said customer, main microcomputer for transmitting select codes for specifying a part of said vending machine communicated with and instruction code data respectively to the customer unit, the coin mechanism and said vending apparatus, at most four common signal lines for carrying serial transmission of select code and command data respectively between to the front panel unit, the coin mechanism, the vending apparatus and main microcomputer, first sub-microcomputer provided in said customer unit for controlling display operation of said money amount display and said sold-out displays, for detecting the operation of said selection switch by a customer, and is coupled to said main microcomputer through said signal line for communication with said main microcomputer, said first sub-microcomputer including:

means for producing selected commodity data respresenting the types of said selected articles through detection of operation of said selection switch by said customer, decoding means for decoding the select code and the command data transmitted from the main microcomputer, transmitting/receiving means for an on-line mode when said select code transmitted from said main microcomputer corresponds to said front panel unit, transmits selected commodity data serially through said signal line in response to command data indicating a transmission request of said selected commodity data to said main microcomputer, and receives data, indicating one of inserted money amount, remaining money amount after sales, and sold out article calculated by said main microcomputer, transmitted serially through said signal line from said main microcomputer in response to input of command data indicating the reception request of data, means for displaying received money amount data onto and money amount display, and means for displaying on said sold-out display the sold-out article to be shown by the received sellout data, a second sub-microcomputer in said coin mechanism for detecting an inserteed coin signal produced in said coin detector through an inserting operation of a proper coin by a customer, for detecting said change detector whether or not paying change is available, for controlling change delivery operation by said change payment unit, and is coupled to said main microcomputer through said signal line for communication with said main microcomputer, said second sub-microcomputer including:

inserted coin signal input means for inputting the inserted coin signal produced in said coin detector, detecting means for detecting existence of change by said change detector, select code decoding means for decoding select code and command data transmitted from said main microcomputer, transmitting/receiving means for transmitting data serially to said main microcomputer through said signal line in response to input of command data indicating a transmission request to said main microcomputer with respect to data indicating said inserted coin or existence of said remaining coin and for receiving paying data indicating change-to-be-paid serially transmitted from said main microcomputer in response to input of command data showing reception request of said data in on-line mode when said select code transmitted from the main microcomputer corresponds to said coin mechanism, and means for controlling said change payment unit so that said change may be paid in accordance with payment data received, a third sub-microcomputer provided in said vending apparatus for controlling article delivery operation of said article delivery apparatus for detecting availability of said selected article according to said sellout switch, coupled to said main microcomputer through said signal line for communication with said main microcomputer, said third sub-microcomputer including:

detecting means for detecting whether or not sold articles exist according to said sellout switch to produce sold-out data, decoding means for decoding said select code and said command data to be transmitted from said main microcomputer, transmitting/receiving means for transmitting said sold-out data serially to said main microcomputer through said signal line in response to an input of said command data indicating transmission request of said sold-out data to said main microcomputer, and for receiving sale commodity data indicating kinds of selling articles to be transmitted serially from said main microcomputer in response to input of command showing the reception request of data, in an on-line mode when said select code data transmitted from said main microcomputer corresponds to said data from said selling apparatus, and controlling means for controlling said vending apparatus so that an article selected by a customer is delivered through said received sale commodity data, said main microcomputer further including:

memory means having a price of each article stored therein in accordance with types of said articles, calculating means for calculating inserted money amount from data indicating said inserted coin, money amount means for calculating remaining money amount after the sale of said article, comparing means for comparing one of said inserted money amount and said remaining money amount and respective article prices and determining said article purchasable by said customer in accordance with data showing existence of change and sold-out data, transmitting means for transmitting sale commodity data showing the sales of said article to said third sub-microcomputer when an article selected by a customer, indicated by said selected commodity data received from said first sub-microcomputer, is purchasable, inserted money amount transmitting means for transmitting one of said inserted money amount calculated and said money amount data showing remaining money amount, and payment data producing means for producing payment data in accordance with said remaining amount money during said change payment operating for transmitting said data to said second sub-microcomputer.

9. A control system for an automatic vending machine in accordance with claim 8, further including a first test switch connected with said first sub-microcomputer having means for turning on said corresponding sold-out display in response to operation of said selection switch after said first test switch has been operated, and means for indicating a test pattern on said money amount display by operation of said first test switch, a second test switch connected with said second sub-microcomputer having means for controlling said change payment unit so as to pay out the same kinds of coin at said inserted coin upon generating said inserted coin signal in response to kinds of the inserted coin when said second test switch has been operated, and a third test switch coupled to said third sub-microcomputer having means for controlling sequentially article delivery operation of said vending apparatus provided in accordance with types of articles purchasable by the customer in accordance with operation of said third test switch.

* * * * *